US007059294B2

(12) United States Patent
Wright

(10) Patent No.: US 7,059,294 B2
(45) Date of Patent: Jun. 13, 2006

(54) ORBITAL ENGINE

(75) Inventor: Michael D. Wright, Casey, IL (US)

(73) Assignee: Wright Innovations, LLC, Casey, IL (US)

( * ) Notice: Subject to any disclaimer, the term of this patent is extended or adjusted under 35 U.S.C. 154(b) by 0 days.

(21) Appl. No.: 10/855,827

(22) Filed: May 27, 2004

(65) Prior Publication Data

US 2005/0263129 A1 Dec. 1, 2005

(51) Int. Cl.

| | |
|---|---|
| ***F02B 53/04*** | (2006.01) |
| ***F02B 50/10*** | (2006.01) |
| ***F01C 1/08*** | (2006.01) |
| ***F01C 1/00*** | (2006.01) |
| ***F01C 1/30*** | (2006.01) |

(52) U.S. Cl. ..... 123/233; 123/238; 123/229; 123/206; 418/195; 418/38; 418/5

(58) Field of Classification Search ..... 123/233, 123/229, 238, 232, 248, 206; 418/195, 224, 418/227, 5, 7, 38

See application file for complete search history.

(56) References Cited

U.S. PATENT DOCUMENTS

| | | | | | |
|---|---|---|---|---|---|
| 889,439 | A | * | 6/1908 | Carter | 418/195 |
| 1,079,743 | A | * | 11/1913 | Callaway | 418/5 |
| 1,106,666 | A | | 8/1914 | Miller | 723/233 |
| 1,266,605 | A | * | 5/1918 | Madero | 418/195 |
| 1,332,468 | A | * | 3/1920 | Henig et al. | 123/238 |
| 1,704,254 | A | * | 3/1929 | Jaffe | 123/229 |
| 1,720,098 | A | * | 7/1929 | Shreffler et al. | 123/229 |
| 1,997,119 | A | * | 4/1935 | Rice, Jr. et al. | 123/233 |
| 2,273,625 | A | * | 2/1942 | Concannon | 123/238 |
| 2,988,008 | A | | 6/1961 | Wankel | |
| 3,354,871 | A | * | 11/1967 | Skrob | 123/229 |
| RE27,191 | E | * | 10/1971 | Skrob | 123/229 |
| 3,867,912 | A | * | 2/1975 | Parr et al. | 123/238 |
| 3,897,756 | A | * | 8/1975 | Upchurch | 123/238 |
| 4,035,111 | A | | 7/1977 | Cronen, Sr. | 418/38 |
| 4,077,365 | A | | 3/1978 | Schlueter | |
| 4,078,529 | A | | 3/1978 | Warwick | |
| 4,242,591 | A | | 12/1980 | Harville | 290/112 |

(Continued)

FOREIGN PATENT DOCUMENTS

| | | |
|---|---|---|
| AU | 467415 | 1/1973 |

(Continued)

OTHER PUBLICATIONS

Unknown Author, "History," http://www.axialvectorengine.com/History.htm, three pages.

(Continued)

*Primary Examiner*—Thai-Ba Trieu
(74) *Attorney, Agent, or Firm*—Baker & Daniels LLP

(57) ABSTRACT

An engine is disclosed including at least one piston which is positioned within a toroidal piston chamber. A method of operating an engine is disclosed wherein a piston is advanced in a toroidal piston chamber past a first valve and the first valve is closed to form a first ignition chamber area located within the piston chamber between the first valve and the rear side of the piston. A second valve is closed ahead of the piston to form a first exhaust removal chamber area located within the piston chamber between the second valve and the front side of the piston, the exhaust removal chamber including exhaust gases from a preceding ignition which occurred in the first ignition chamber area. A fuel mixture is introduced into the first ignition chamber area and ignited thereby advancing the piston further along the toroidal piston chamber.

16 Claims, 21 Drawing Sheets

U.S. PATENT DOCUMENTS

| | | | | |
|---|---|---|---|---|
| 4,421,073 | A | 12/1983 | Arregui et al. | |
| 4,683,852 | A | 8/1987 | Kypreos-Pantazis | 123/230 |
| 4,753,073 | A | 6/1988 | Chandler | |
| 4,836,149 | A | 6/1989 | Newbold | |
| 5,046,465 | A | 9/1991 | Yi | 123/248 |
| 5,203,297 | A | 4/1993 | Iversen | 123/248 |
| 5,222,463 | A | 6/1993 | Farrell | |
| 5,303,546 | A | 4/1994 | Farrell | |
| 5,323,737 | A | 6/1994 | Farrell | |
| 5,342,176 | A | 8/1994 | Redlich | |
| 5,467,744 | A | 11/1995 | Farrell | |
| 5,645,027 | A | 7/1997 | Esmailzadeh | |
| 6,526,925 | B1 | 3/2003 | Green, Jr. | |
| 6,543,225 | B1 | 4/2003 | Scuderi | |
| 6,546,908 | B1 | 4/2003 | Pekau | 123/206 |
| 6,672,274 | B1 * | 1/2004 | Winterpacht | 123/232 |
| 6,722,127 | B1 | 4/2004 | Scuderi et al. | |
| 6,910,397 | B1 | 6/2005 | Shapiro et al. | |
| 2004/0244762 | A1 | 12/2004 | Shapiro et al. | |
| 2004/0255882 | A1 | 12/2004 | Branyon et al. | |
| 2005/0016475 | A1 | 1/2005 | Scuderi et al. | |

FOREIGN PATENT DOCUMENTS

| | | | |
|---|---|---|---|
| WO | WO 2003/014527 | A1 | 2/2003 |
| WO | WO 2003/014598 | A1 | 2/2003 |
| WO | WO 2004/076819 | A2 | 9/2004 |

OTHER PUBLICATIONS

Unknown Author, "Axial Vector™ Engine," http://www.axialvectorengine.com/AxialVector.htm, four pages.

Weissler, Paul, "The Little Engine That May," Popular Mechanics, May 1, 2000, three pages.

Stokes, Myron D., "Quantum Parallel: The Saint-Hilaire 'Quasiturbine' As The Basis For a Simultaneous Paradigm Shift In Vehicle Propulsion Systems," Dec. 15, 2003, fourteen pages.

Unknown Author, "Quasiturbine in the Medias," http://www.quasiturbine.com/ERelationInTheMedias.htm, eleven pages.

Unknown Author, "Quasiturbine—A New Approach," http://quasiturbine.promci.qc.ca/, six pages.

Jayasuriya, L., "The Internal Combustion Engine with Oscillating Flaps," http://www.oengine.com/, four pages.

Jayasuriya, L., "The New Internal Combustion Engine," http://www.oengine.com/prototype.htm, seven pages.

Unknown Author, "Prospects of Oscillator Engine," http://www.oengine.com/merits.htm, three pages.

VGT Technologies, Inc., "Roundengine," www.roundengine.com/roundengine_details/patenten_technology.htm, 1 pg.

VGT Technologies, Inc., "Roundengine: How it Works," www.roundengine.com/howitworks/howitworks.htm, 10 pgs.

Karim, G.A. and Shrestha, O.M. Bade, "The V.G.T.' Engine, The Performance of a Variable Geometry Toroidal Engine," VGT Technologies, Inc., 46 pgs.; and Appendix: Karim, G.A. and Shrestha, O.M. Bade, "A Description of the Predictive Model Modified for Application to the VGT Engine", S.A.E. Paper No. 1999-01-3482, 18 pgs.

* cited by examiner

ORBITAL ENGINE

BACKGROUND OF THE INVENTION

1. Technical Field

This invention generally relates to internal combustion engines and more specifically relates to internal combustion engines having an orbital piston movement in which the pistons move in a toroidal path.

2. Prior Art

Internal combustion engines generally can be categorized into three primary types: reciprocating or bore and stroke, rotary, and turbine. Each of these three types is well established and has been continuously enhanced throughout their long lineages.

A reciprocating or bore and stroke engine is an internal-combustion engine in which the crankshaft is turned by pistons moving up and down in cylinders. Typically, for automotive use, a reciprocating engine is of the four-stroke variety, in which an explosive mixture is drawn into the cylinder on the first stroke and is compressed and ignited on the second stroke, work is done on the third stroke and the products of combustion are exhausted on the fourth stroke.

A rotary engine is an internal-combustion engine in which power is transmitted directly to rotating components. For automotive uses, the Wankel® engine used in Mazda® automobiles is a common example. In other words, a rotary engine is an internal-combustion engine having combustion chambers generally with a triangular shaped piston that oscillates as it rotates.

A turbine engine is an engine in which the energy in a moving fluid is converted into mechanical energy by causing a bladed rotor to rotate. A typical turbine engine will have a set of rotor blades that induce and compress air. Fuel then is added and ignited. The expanding hot combustion gases accelerate as they move through a set of turbine blades. The set of turbine blades is mechanically connected to the set of rotor blades, providing the power to make the set of rotor blades continue to spin and draw in fresh air. Broadly, a turbine is any of various machines in which the energy of a moving fluid is converted to mechanical power by the impulse or reaction of the fluid with a series of buckets, paddles, or blades arrayed about the circumference of a wheel or cylinder.

Internal combustion engines of each of these three general types have their advantages and disadvantages. A reciprocating engine has a mature design, relatively low cost, moderate power to weight ratio, moderate size, and moderate fuel efficiency. A rotary engine has a less mature design, moderate cost, higher power to weight ratio, small size, and moderate to low fuel efficiency. A turbine has a mature design, high cost, high power to weight ratio, large size, and low fuel efficiency.

Thus, it can be seen that a need exists for an internal combustion engine combining at least some of the advantages of the three general types of internal combustion engines. For example, a preferred engine may have the relatively low cost of manufacture of a reciprocating engine and the high power to weight ratio and small size of a rotary engine, along with a higher fuel efficiency not generally found in any internal combustion engine. The present invention is directed to such a preferred engine.

BRIEF SUMMARY OF THE INVENTION

The present invention is different from any engine known to the inventor. Unlike known engines, the present invention is not a rotary, turbine, or reciprocating engine. The engine of the present invention does have pistons, however the pistons do not travel in a straight line, like in known engines, but instead the pistons travel in a circle, and therefore do not have to stop and reverse direction, such as at the top and bottom of a stroke, allowing the engine of the present invention to operate efficiently. The orbital motion of the engine of the present invention also lends itself to higher power and smoother operation. Like a turbine engine, the circular motion of the engine of the present invention is efficient. However, unlike the engine of the present invention, a turbine engine does not have a closed volume for the force to act upon, and thus a turbine engine loses a quantity of power. To make up for this loss of power, a turbine engine must use more fuel, making it less economical.

The engine of the present invention comprises an engine block preferably formed in two halves, although more or fewer sections (halves, thirds, quarters, etc.) can be used depending on the methods of manufacturing or the manufacturer's desires. For example, for a smaller engine, two halves should be suitable, while for a larger engine, the engine block may need to be formed from many sections. When attached together, the engine block is in the form of a torus having a generally hollow interior, which is the equivalent of the cylinder of a conventional piston stroke engine, through and about which the pistons travel in a circular or orbital manner. A crankshaft is located axially through the center of the torus perpendicular to the plane of the torus. A connecting disc, which roughly corresponds to the connecting rods in a conventional reciprocating engine, extends radially between the crankshaft and the pistons, thus connecting the pistons to the crankshaft. Alternatively, a crankring is located peripherally outside the torus with the connecting disc extending radially outwardly between the pistons and the crankring, thus connecting the pistons to the crankring. Connecting rods or their equivalent can be an alternate to the connecting disc.

To allow the connection between the piston and the crankshaft, the halved engine block has a groove or slot formed or cut circumferentially on the inside diameter of the torus, through which the connecting disc extends. The slot comprises the entire inside circumferential diameter of the torus, thus allowing the connecting disc to rotate an entire 360° through the engine and about the crankshaft. Similarly, to allow the connection between the piston and the crankring, the halved engine block has a groove or slot formed or cut circumferentially on the outside diameter of the torus, through which the connecting disc extends. The slot comprises the entire outside circumferential diameter of the torus, thus allowing the connecting disc to rotate an entire 360° through the engine.

The fuel induction system can be much like a normal reciprocating engine, with an exception of a valve train. Instead of using conventional tappet or poppet valves, the engine of the present invention uses a rotary disc valve, a reed valve, a ball valve, or the like. This allows the engine to rotate at higher revolutions per minute without having the valves float. Additionally, this adds to the operational smoothness of the engine.

These features, and other features and advantages of the present invention, will become more apparent to those of ordinary skill in the relevant art when the following detailed description of the preferred embodiments is read in conjunction with the appended drawings in which like reference numerals represent like components throughout the several views.

BRIEF DESCRIPTION OF THE DRAWINGS

FIGS. 7–10 illustrate the rotation of the engine in four different positions as follows:

DETAILED DESCRIPTION OF THE PREFERRED EMBODIMENTS

Figure 1:
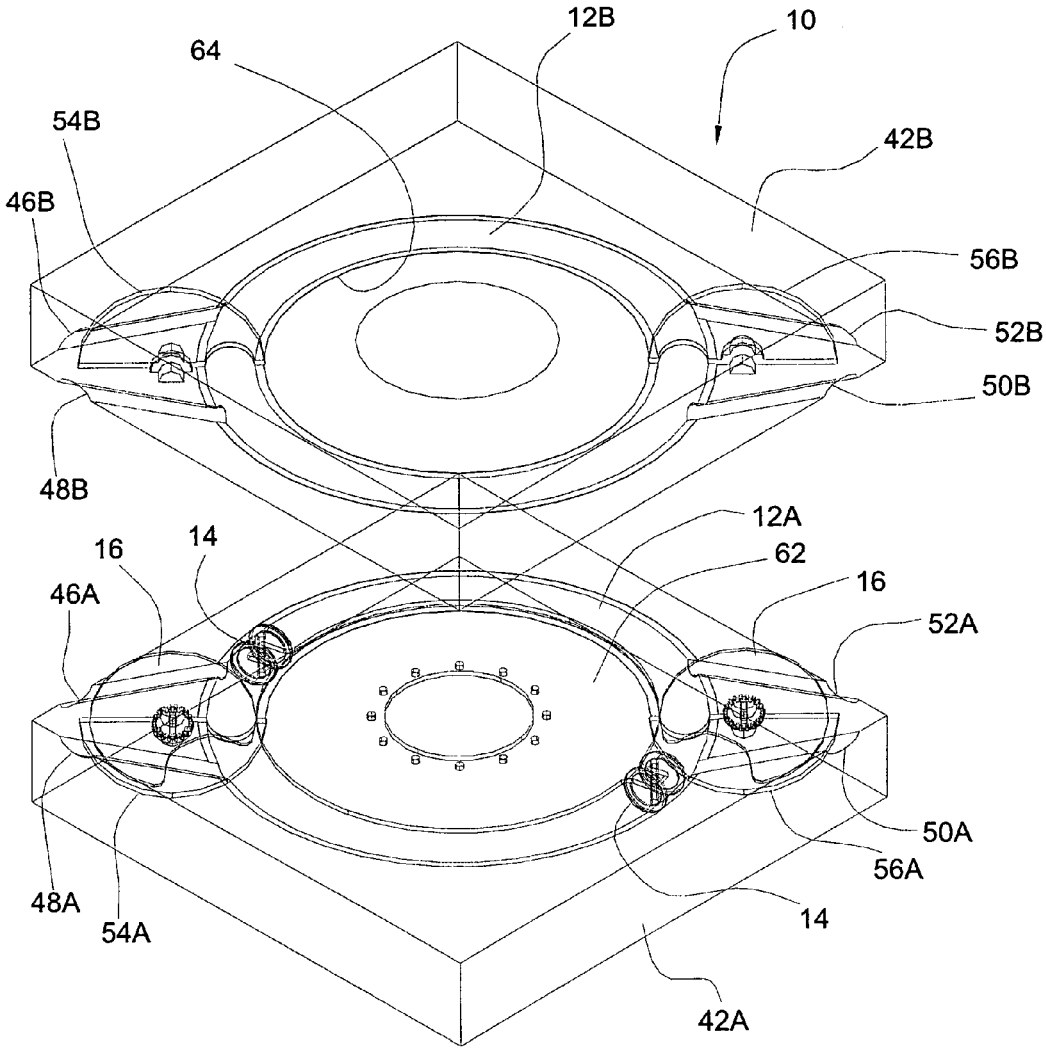
FIG. 1 is an exploded perspective view of the engine of the present invention.
Figure 2:
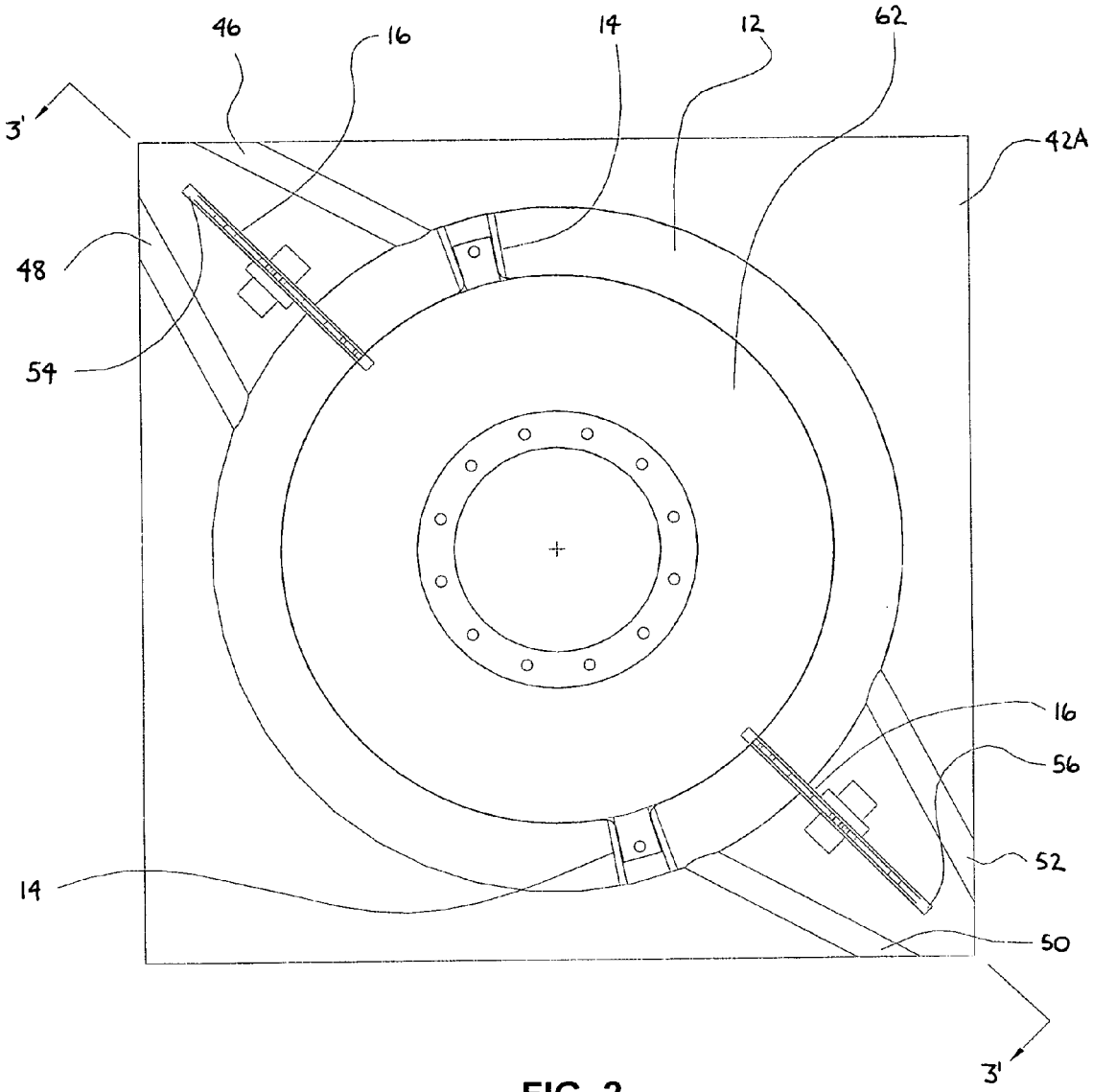
FIG. 2 is a sectional top view of the engine.
Figure 3A:
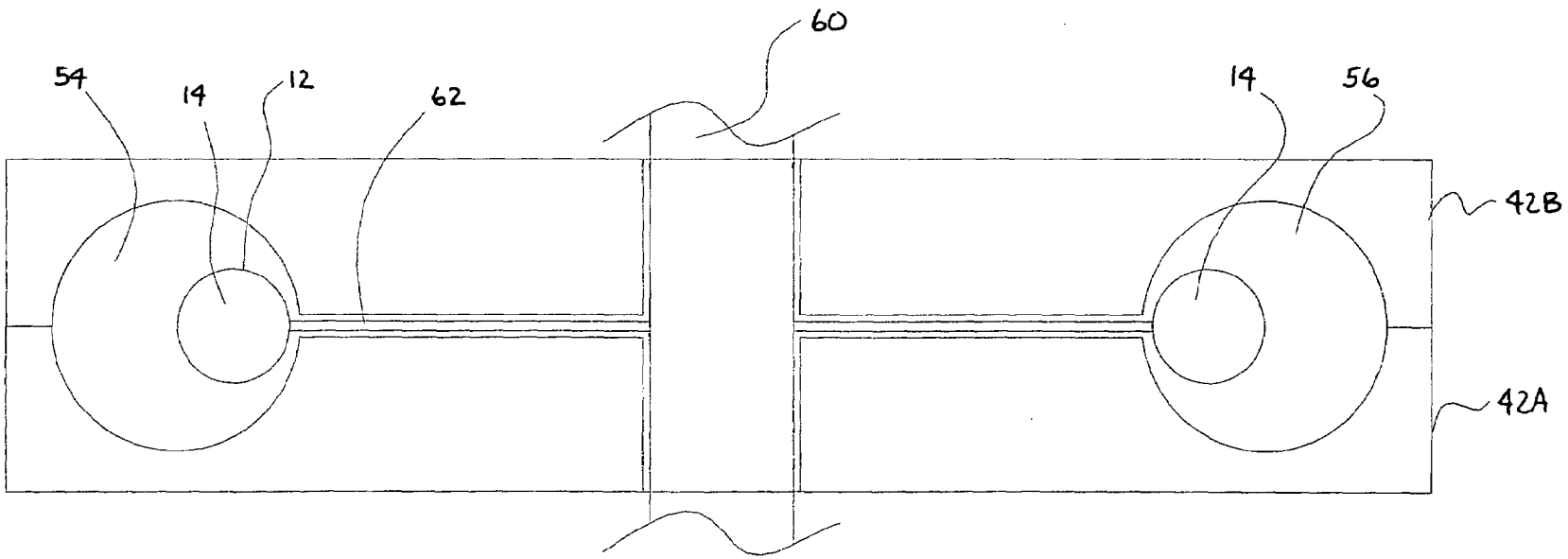
FIG. 3A is a sectional side view of the engine through line 3'—3' of FIG. 2.
Figure 3B:
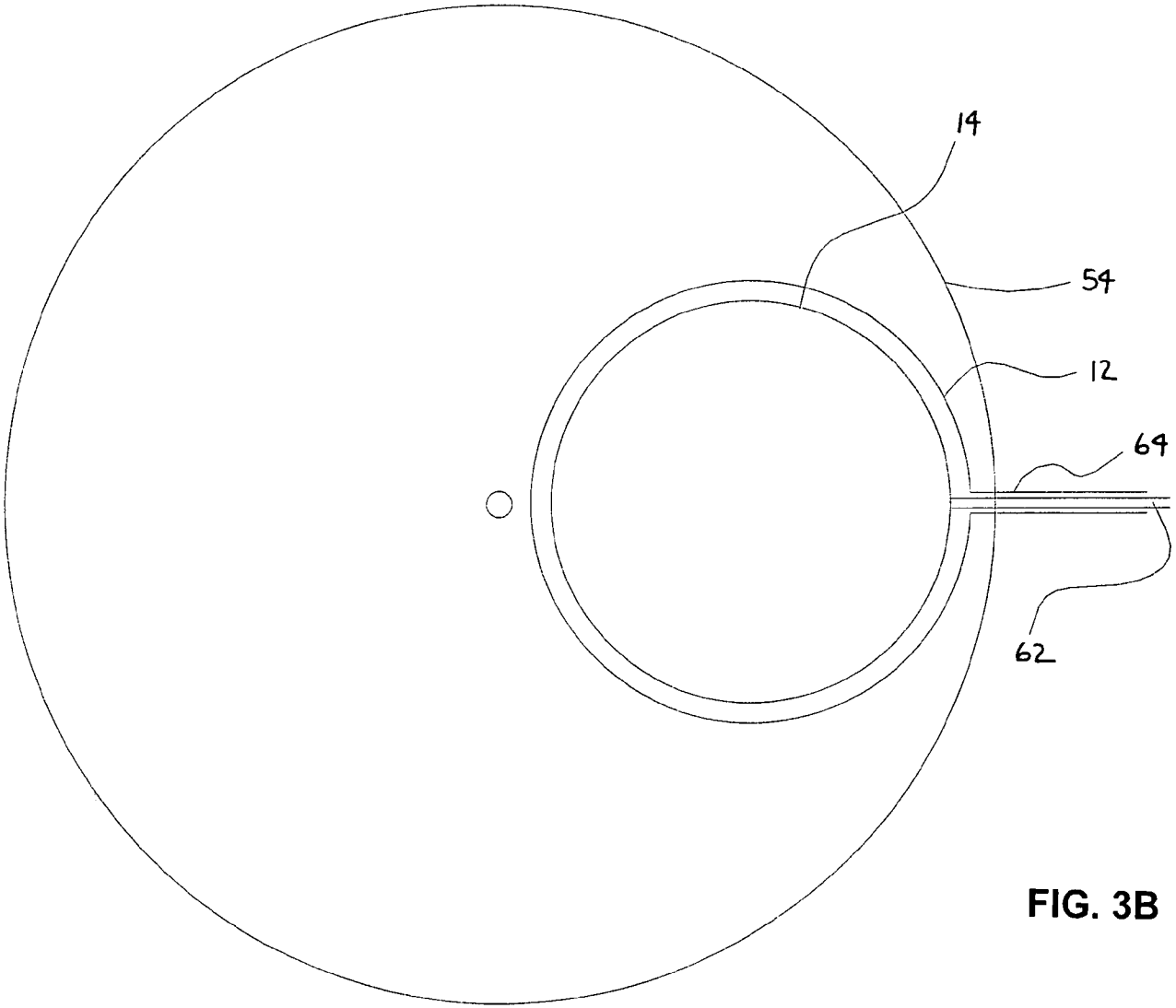
FIG. 3B is an enlarged side view of the left side portion of FIG. 3A.

Referring now generally to FIGS. 1–15, preferred embodiments of the invention are shown. FIG. 1 is an exploded perspective view of the engine 10 of the present invention showing the two half design of the piston chamber 12. FIG. 2 is a sectional top view of a two piston 14 embodiment of the engine 10 showing the relative positioning of the various primary components of the engine 10. FIG. 3A is a sectional side view of the engine through line 3'—3' of FIG. 2 showing the general shape of the piston chamber 12 and the positioning and operation of the chambering valves 16, which in this view are disc valves. FIG. 3B is an enlarged side view of the left side portion of FIG. 3A showing the relationship of the piston to the piston chamber and the valve cavity slot and how the connecting disc interacts with the piston chamber.

Figure 4A:
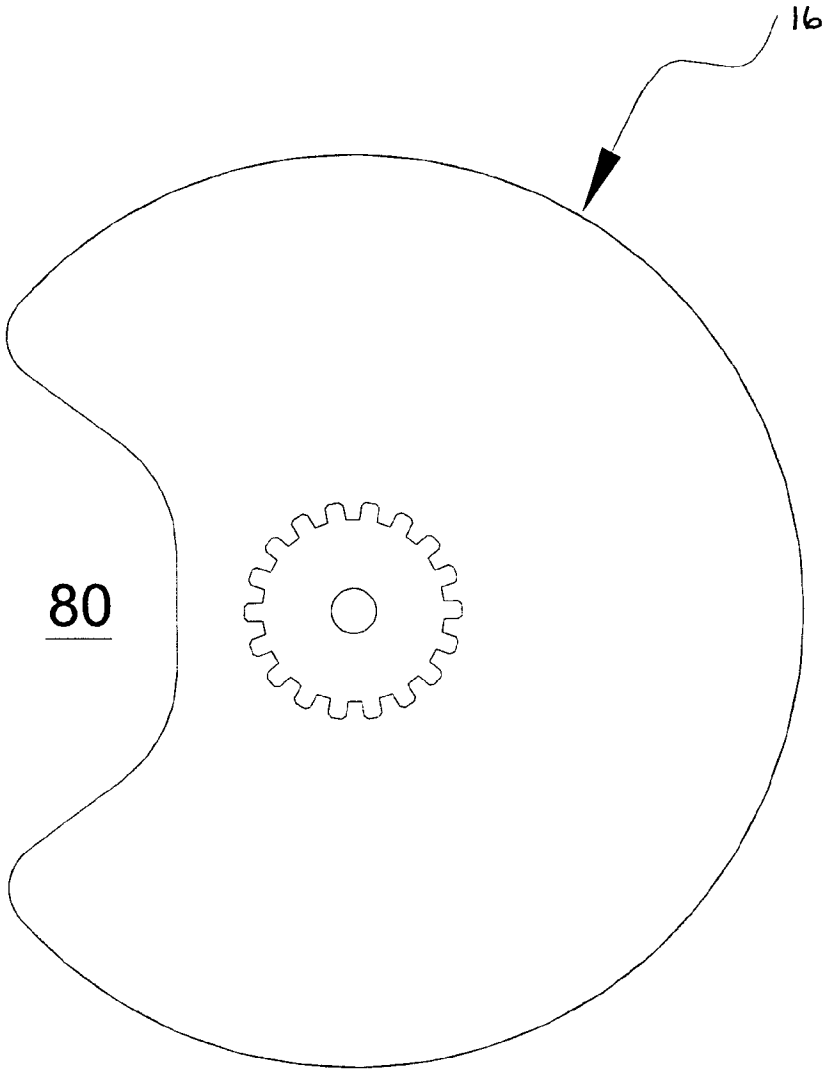
FIG. 4A is a side view of an illustrative chambering valve disc used in the engine.
Figure 4B:
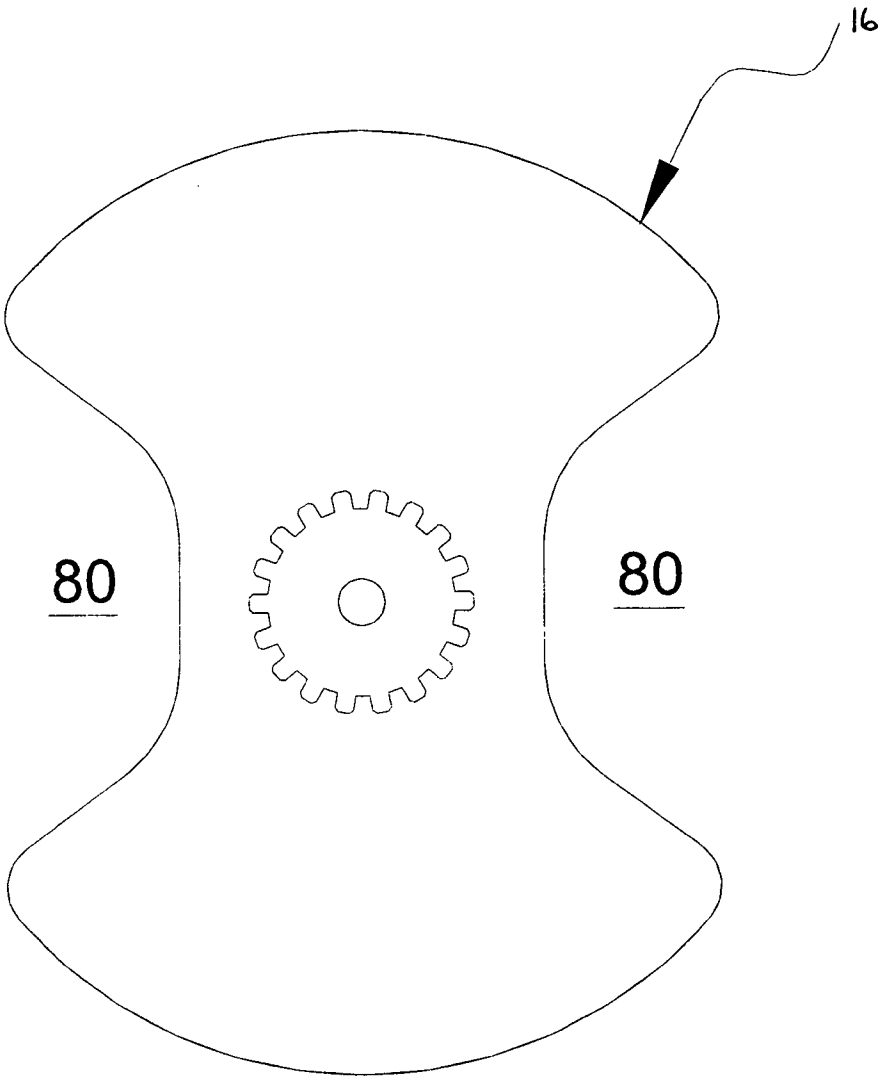
FIG. 4B is a side view of an alternate chambering valve disc used in the present engine.
Figure 15:
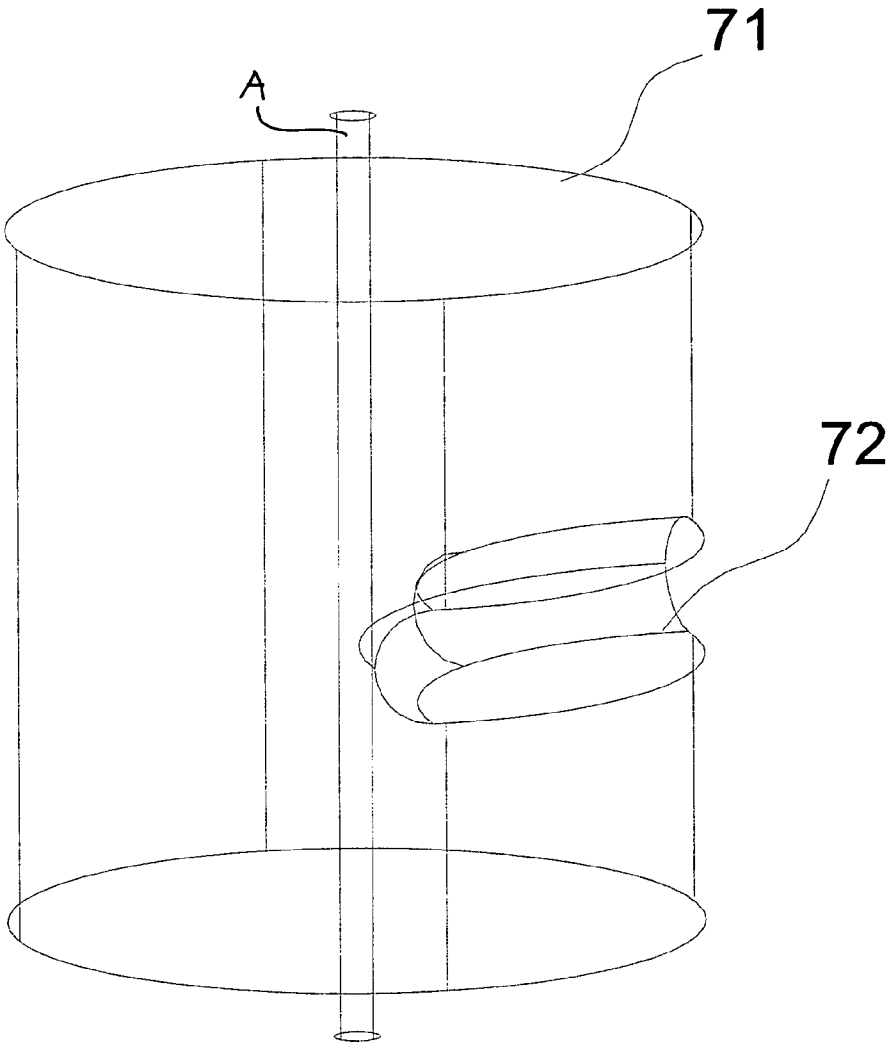
FIG. 15 is a side view of an alternate chambering valve cylinder used in the present invention.

FIG. 4A is a side view of an illustrative disc valve 16 used in the engine showing a preferred single notch 80 structure. FIG. 4B is a side view of an alternate illustrative disc valve 16 used in the engine showing a double notch 80 structure. FIG. 15 is a side view of an alternate chambering valve cylinder 71 used in the engine showing a cutout notch 72 analogous to notch 80 of disc valve 16.

Figure 5:
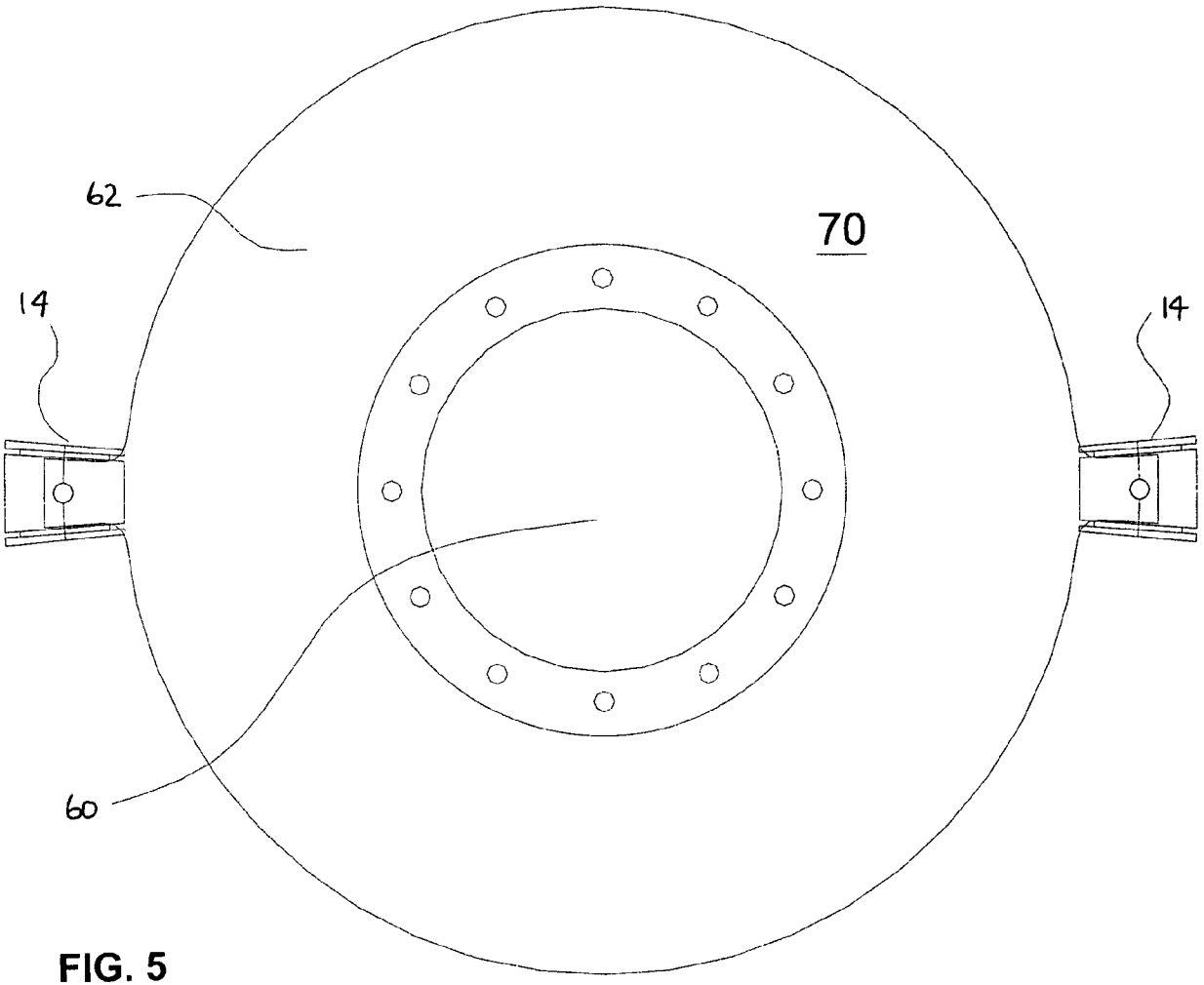
FIG. 5 is a top view of one embodiment of a piston-connecting disc-crankshaft configuration used in the engine.
Figure 6:
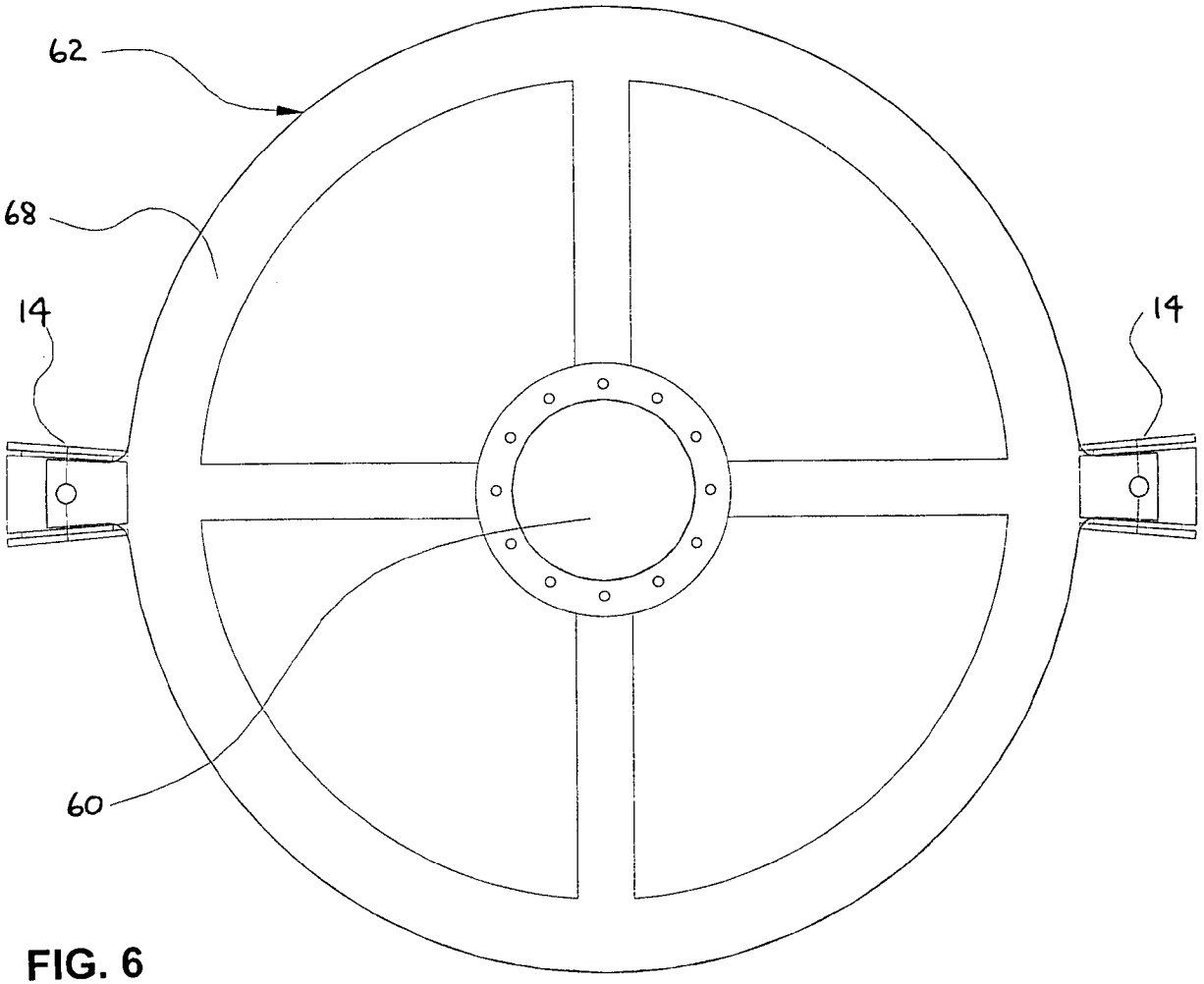
FIG. 6 is a top view of an alternate embodiment of a piston-connecting disc-crankshaft configuration used in the engine.

FIG. 5 is a top view of an alternate embodiment of a configuration showing the relationship between pistons 14, connecting disc 62 and crankshaft 60 that can be used in engine 10, which in this view is a solid configuration. FIG. 6 is a top view of one embodiment of a configuration showing the relationship between pistons 14, connecting disc 62 and crankshaft 60 that can be used in engine 10, which in this view is a spoke type of configuration.

FIGS. 7–10 illustrate the rotation of the engine in four different positions. FIGS. 7A and 7B illustrate an arbitrary initial position with the chambering valves 16 open and the pistons 14 passing through the chambering valves 16. FIGS. 8A and 8B illustrate a position approximately 30° from the initial position with the chambering valves 16 closing and the fuel mixture 30 beginning to enter the piston chamber 12 between the pistons 14 and the respective chambering valves 16 by way of fuel intake ports 46, 50. FIGS. 9A and 9B illustrate a position approximately 60° from the initial position with the fuel mixture 30 ignited and expanding, imparting power to the pistons. FIGS. 10A and 10B illustrate a position approximately 90° from the initial position with the pistons 14 continuing their powered travel through the piston chamber 12 and forcing exhaust gases ahead of them and out of exhaust ports 48, 52.

Figure 11:
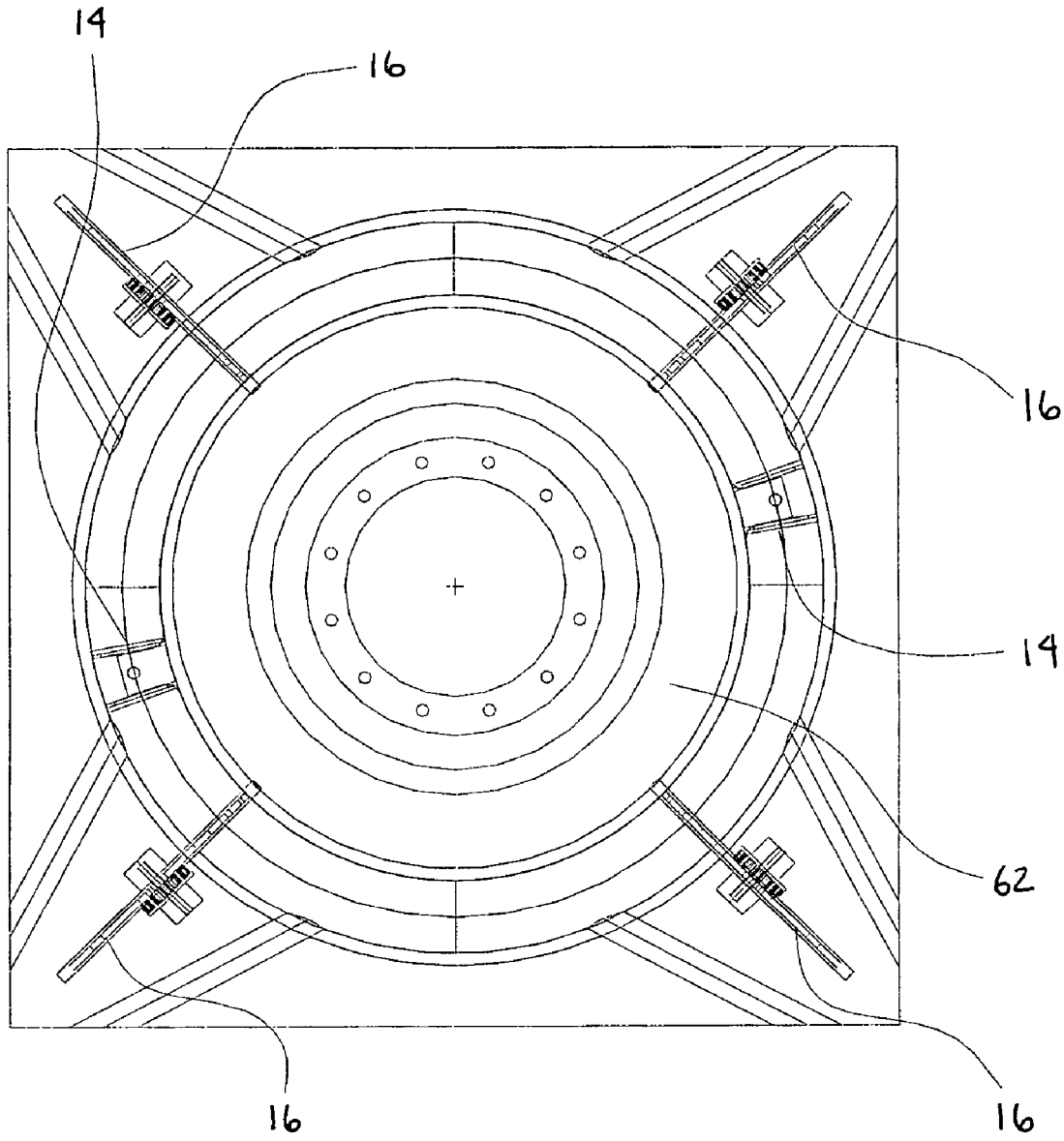
FIG. 11 is a sectional top view of an alternative embodiment of the engine with multiple chambering valves per piston.
Figure 12:
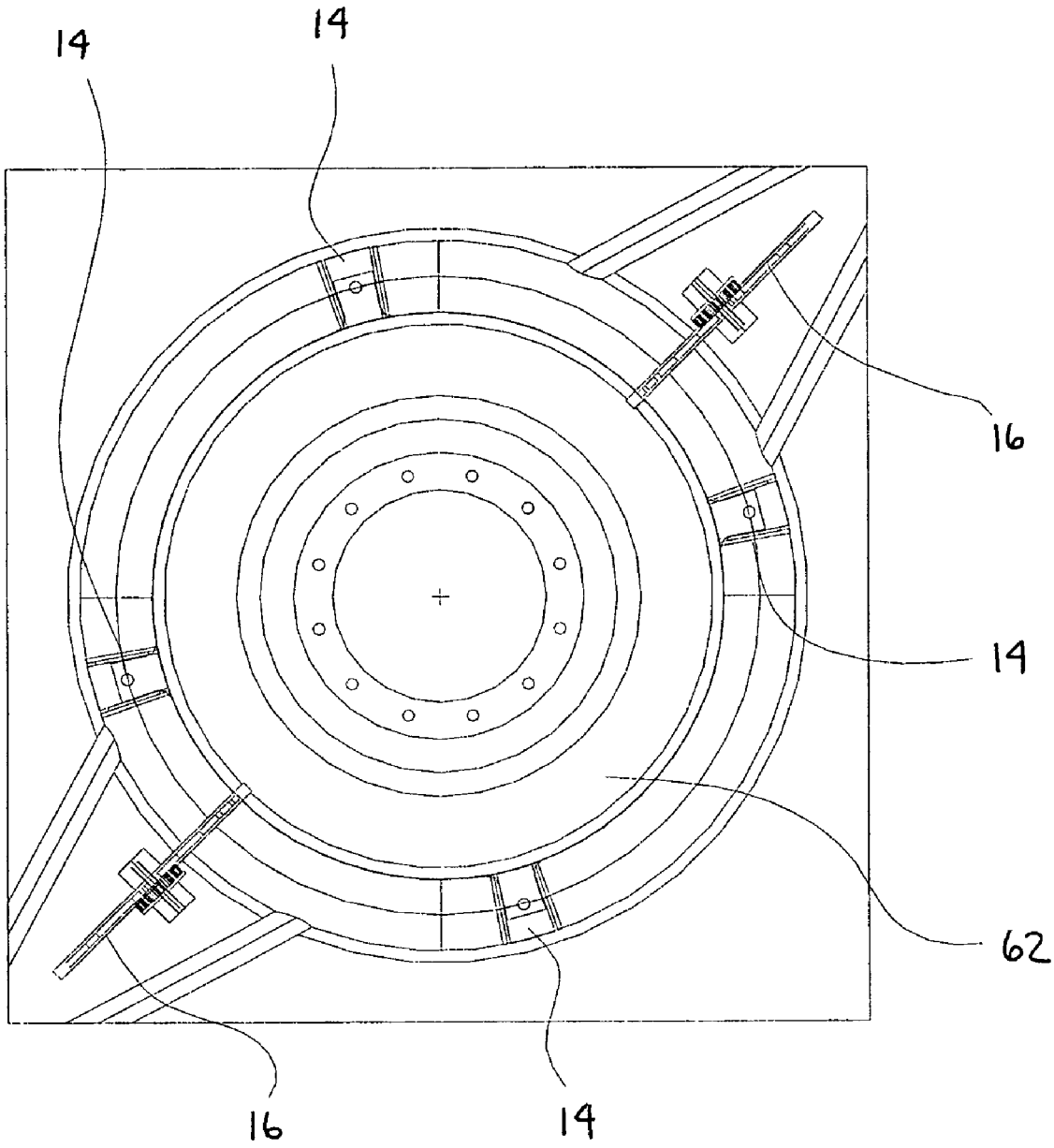
FIG. 12 is a sectional top view of an alternative embodiment of the engine with multiple pistons per chambering valve.

FIG. 11 illustrates an alternative embodiment with multiple chambering valves 16 per piston 14. FIG. 12 illustrates an alternative embodiment with multiple pistons 14 per chambering valve 16. Further, in a multiple module configuration, each module can have one piston and chambering valve 16, preferably as long as the remaining modules are staggered to create a balanced force. Likewise, depending on size, weight and other factors, a single piston 14, single chambering valve 16 design can be built.

Figure 13:
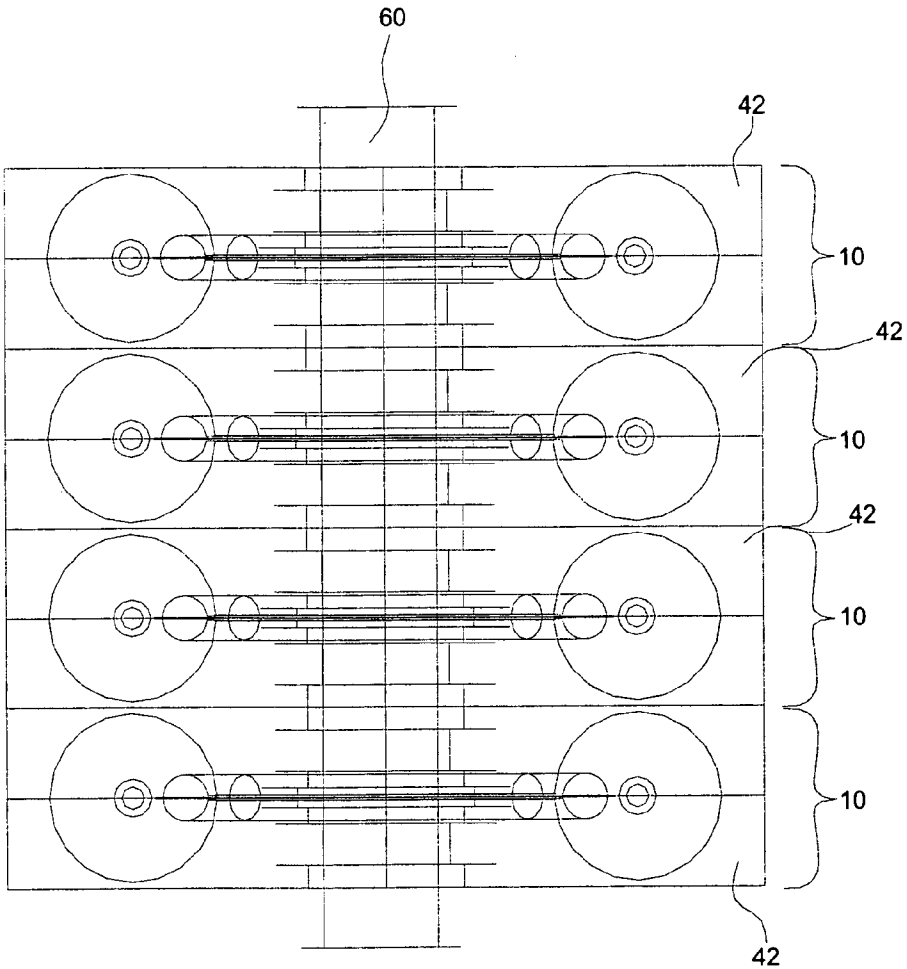
FIG. 13 shows a modular or multi-unit design incorporating four engine units.

FIG. 13 shows a modular or multi-unit design incorporating four engine units. More specifically, FIG. 13 shows the use of four engines 10 connected serially to a common crankshaft 60 to create a single engine with more power. Any number of engine units can be connected together to create engines of more or less power. Further, engine 10 can be designed with a single piston 14 with single or multiple chambering valves 16, or a single or multiple pistons 14 with a single chambering valve 16.

Figure 14:
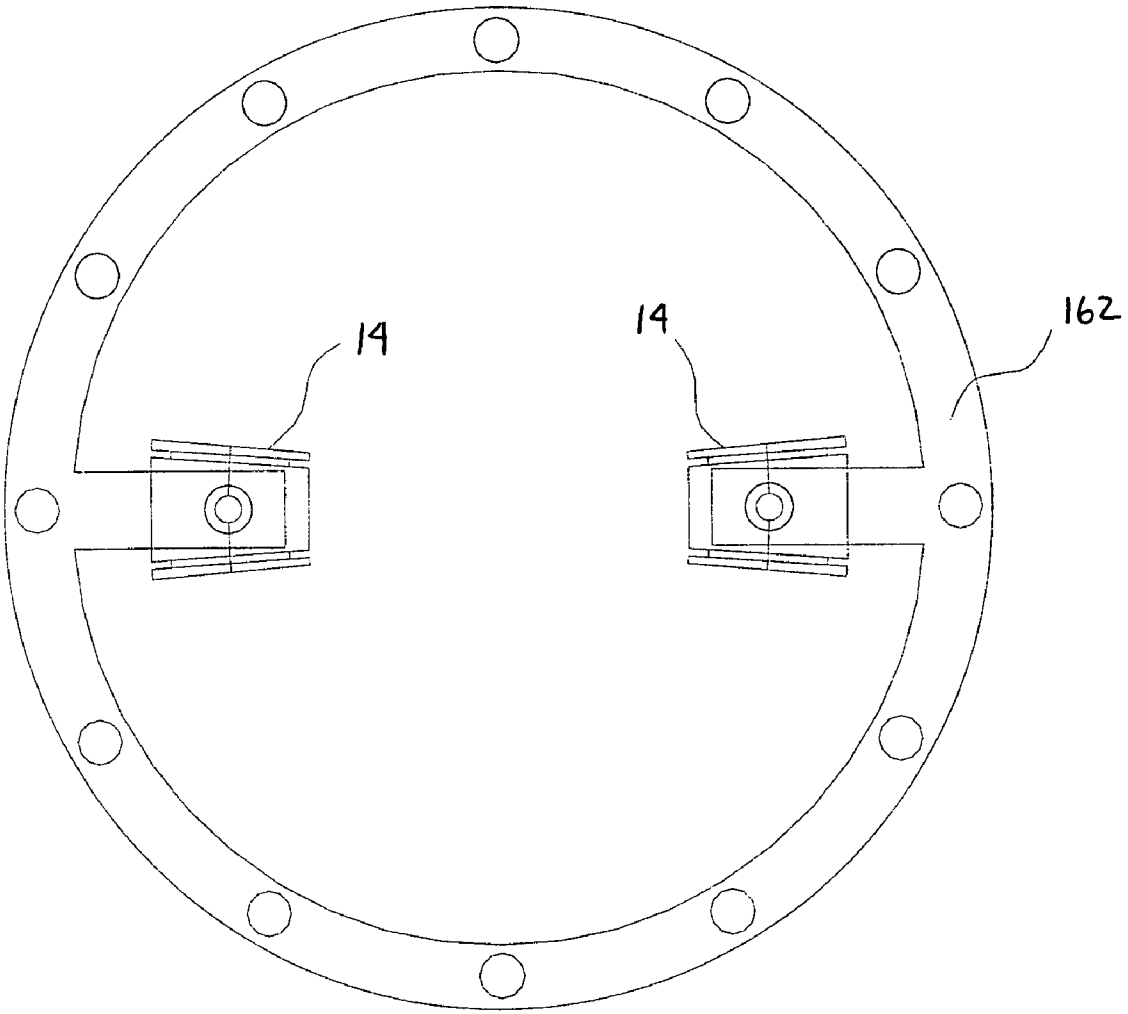
FIG. 14 is a top view of one embodiment of a piston-connecting disc-crankring configuration used in the engine.

FIG. 14 shows a top view of one embodiment of a piston-connecting disc-crankring configuration used in the engine as an alternative to a connecting disc. The crankring is located outside of the main body of the engine, while the connecting disc is located within the main body of the engine.

As shown in FIG. 1, an illustrative embodiment of engine 10 comprises first block half 42A and second block half 42B, which combine to result in engine block 42. With only minor or no exceptions, first block half 42A and second block half 42B can be identical to each other. Although engine 10 and thus engine block halves 42A, 42B can be oriented in any desired plane, for consistency of description engine 10 will be illustrated in the FIGs. and disclosed in this description of the preferred embodiments in a horizontal plane. In this regard, first block half 42A will be referred to as the bottom half and its associated elements and components will be referred to as the respective bottom elements and components and second block half 42B will be referred to as the top half and its associated elements and components will be referred to as the respective top elements and components. However, this is in no way meant to limit the orientation of engine 10 to be horizontal, as engine 10 can operate vertically or angularly.

Further, this specification discloses an illustrative engine 10 having two pistons 14, two chambering valves 16 and two associated chambering valve cavities 54, 56 in which chambering valves 16 spin, two fuel intake ducts 46, 50 (one associated with each chambering valve 16), and two exhaust ducts 48, 52 (one associated with each chambering valve 16). However, the invention is not limited to a two-piston and two-valve design, and may comprise any number of pistons and valves.

First block bottom half 42A comprises bottom piston chamber 12A, first intake duct bottom half 46A, first exhaust duct bottom half 48A, second intake duct bottom half 50A, second exhaust duct bottom half 52A, first chambering valve bottom cavity 54A, and second chambering valve bottom cavity 56A. Second block top half 42B comprises top piston chamber 12B, first intake duct top half 46B, first exhaust duct top half 48B, second intake duct top half 50B, second exhaust duct top half 52B, first chambering valve top cavity 54B, and second chambering valve top cavity 56B. When first block bottom half 42A and second block top half 42B are placed together to form engine block 42, the various component halves cooperate with each other, namely, bottom piston chamber 12A cooperates with top piston chamber 12B to form piston chamber 12, first intake duct bottom half 46A cooperates with first intake duct top half 46B to form first intake 46, first exhaust duct bottom half 48A cooperates with first exhaust duct top half 48B to form first exhaust duct 48, second intake duct bottom half 50A cooperates with second intake duct top half 50B to form second intake 50, second exhaust duct bottom half 52A cooperates with second exhaust duct top half 52B to form second exhaust duct 52, first chambering valve bottom cavity 54A cooperates with first chambering valve top cavity 54B to form first chambering valve cavity 54, and second chambering valve bottom cavity 56A cooperates with second chambering valve to cavity 56B to form second chambering valve cavity 56.

With the block halves 42A, 42B bolted together to form engine block 42, engine block 42 comprises a torus having a generally hollow interior, which is piston chamber 12, which is the equivalent of the cylinder or cylinders of a conventional piston stroke engine. Pistons 14 travel in a circular or orbital manner through and around piston chamber 12. Crankshaft 60 preferably is located axially through the center of the torus perpendicular to the plane of the torus, and pistons 14 and crankshaft 60 rotate axially about the axis that is the axial centerline of crankshaft 60. Connecting disc 62 extends radially between crankshaft 60 and pistons 14, thus connecting pistons 14 to crankshaft 60. Alternatively, as shown in FIG. 14, a crankring 162 is located peripherally outside the torus with connecting disc extending radially outwardly between pistons 14 and crankring, thus connecting pistons 14 to crankring 162.

To allow the connection between pistons 14 and crankshaft 60, engine block 42 has a groove or slot 64 formed or cut on the inside circumference (that is, at the extent of the smallest radius or diameter) of the torus, through which connecting disc 62 extends. Slot 64 extends around the entire inside circumference of the torus, thus allowing connecting disc 62 to rotate an entire 360° through engine 10 and about crankshaft 60. Similarly, to allow the connection between pistons 14 and crankring, engine block 42 has a groove or slot (not shown) formed or cut on the outside circumference (that is, at the extent of the largest radius or diameter) of the torus, through which connecting disc 62 extends. In this embodiment, slot extends around the entire outside circumference of the torus, thus allowing connecting disc 62 to rotate an entire 360° through engine 10.

FIG. 2 is a top view of engine 10 with second block top half 42B removed to better show the internal structure of engine 10, particularly the circular shape of piston chamber 12, pistons 14, connecting disc 62, intake ducts 46, 50, and exhaust ducts 48, 52. FIG. 3A is a sectional side view of engine 10 through line 3'—3' of FIG. 2, with second block top half 42B in place, to better show the internal structure of engine 10, particularly chambering valves 16 and chambering valve cavities 54, 56. FIG. 3B is an enlargement of the left side of FIG. 3B to better show the relationship of the various structures of engine 10 and how connecting disc 62 interacts with piston chamber 12.

FIG. 4A is a side view of an illustrative chambering valve 16, namely disc valve 16, used in engine 10. Disc valve 16 is a flat circular plate having a generally trapezoidal notch 80. Disc valve 16 is rotationally mounted within chambering valve cavity 54, 56 such that disc valve 16 extends into piston chamber 12. Disc valve 16 is located in a plane generally normal to the plane of piston chamber 12 such that disc valve 16 rotates through the annular cross-section of piston chamber 12. As discussed in more detail below, as disc valve 16 rotates, it alternately seals piston chamber 12 when the flat circular plate region is rotating through piston chamber 12 and opens piston chamber 12 when notch 80 is rotating through piston chamber 12. When notch 80 is rotating through piston chamber 12, piston 14 can pass unimpeded through notch 80 as piston 14 rotates around piston chamber 12. At other times, the flat circular plate region seals off piston chamber 12 creating a sealed ignition chamber area 90 for ignition of the fuel and a sealed exhaust removal chamber area 92 for exhaustion of combustion products. Notch 80 is sized such that piston chamber 12 remains completely open as piston 14 travels past disc valve 16, thus the reason for the trapezoidal shape rather than a round opening.

Chambering valve 16 is mechanically connected to crankshaft 60 or the equivalent such that chambering valve 16 rotates in a coordinated manner with crankshaft 60. In the two-piston disc valve embodiment shown in the FIGs., disc valve 16 and crankshaft 60 rotate in a 2:1 ratio. That is, as crankshaft 60 rotates once, disc valve 16 must rotate twice to allow both pistons 14 to rotate unimpeded through notch 80. For more or fewer pistons 14, the rotation ratio between disc valve 16 and crankshaft 60 will change according to the number of pistons 14. Alternatively, chambering disc 16 can have a plurality of notches 80, thus allowing a like plurality of pistons 14 to pass by chambering disc 16 per revolution of chambering disc 16. For example, as shown in FIG. 4B a chambering disc 16 having two notches 80 opposite each other would only have to rotate once to allow two pistons to rotate through the notches 80, resulting in chambering disc 16 and crankshaft 60 rotating in a 1:1 ratio for a two-piston two-chambering disc embodiment. Those of ordinary skill in the art can design the appropriate mechanical and gearing linkages, or other types of linkages, between crankshaft 60 or the equivalent and chambering valves 16 such that notch 80 or the equivalent is rotating through piston chamber 12 as piston 14 approaches and passes by chambering valve 16 within piston chamber 12.

Figure 7A:
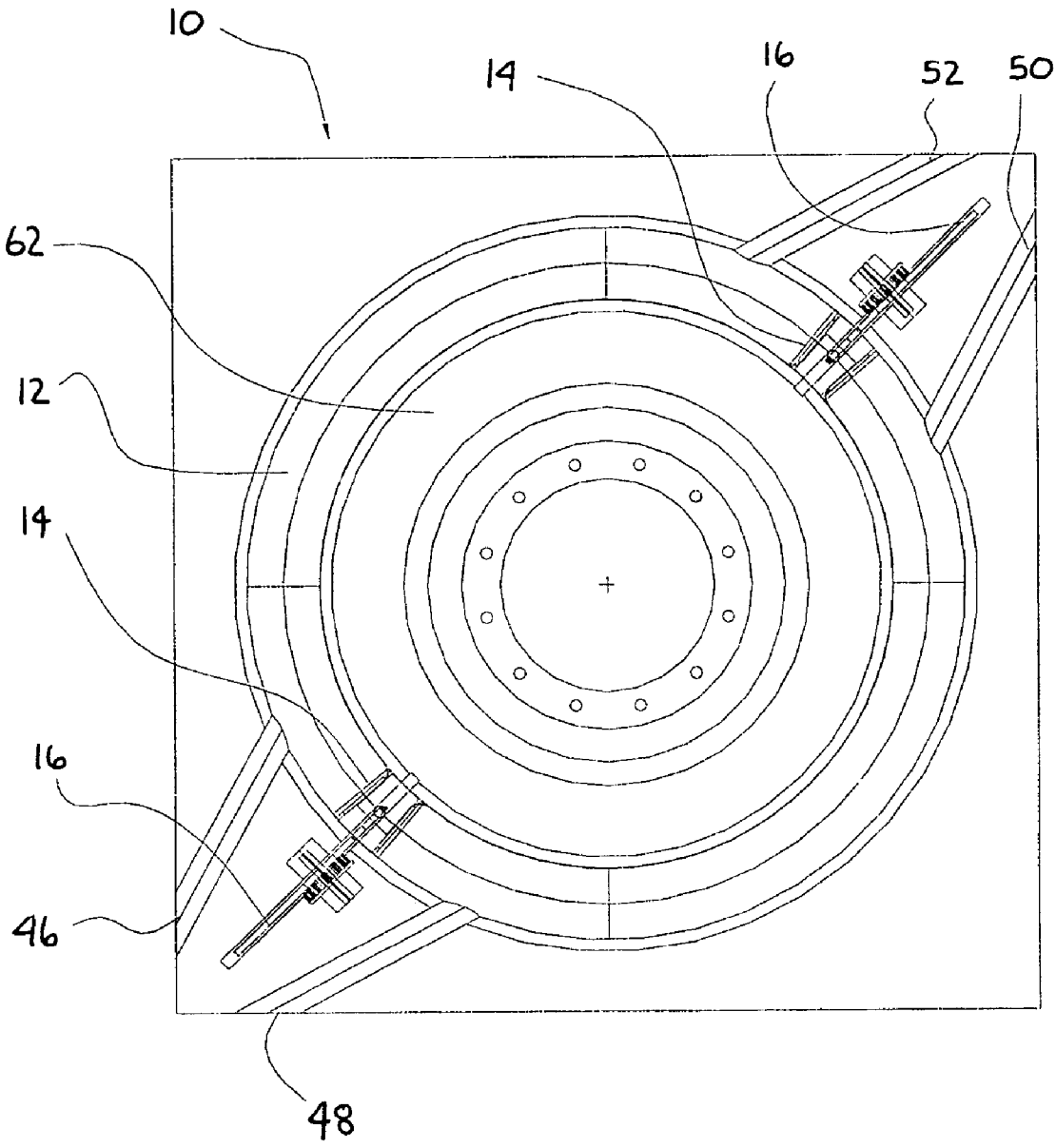
FIG. 7A illustrates a top view of an arbitrary initial position with the disc valve open.
Figure 7B:
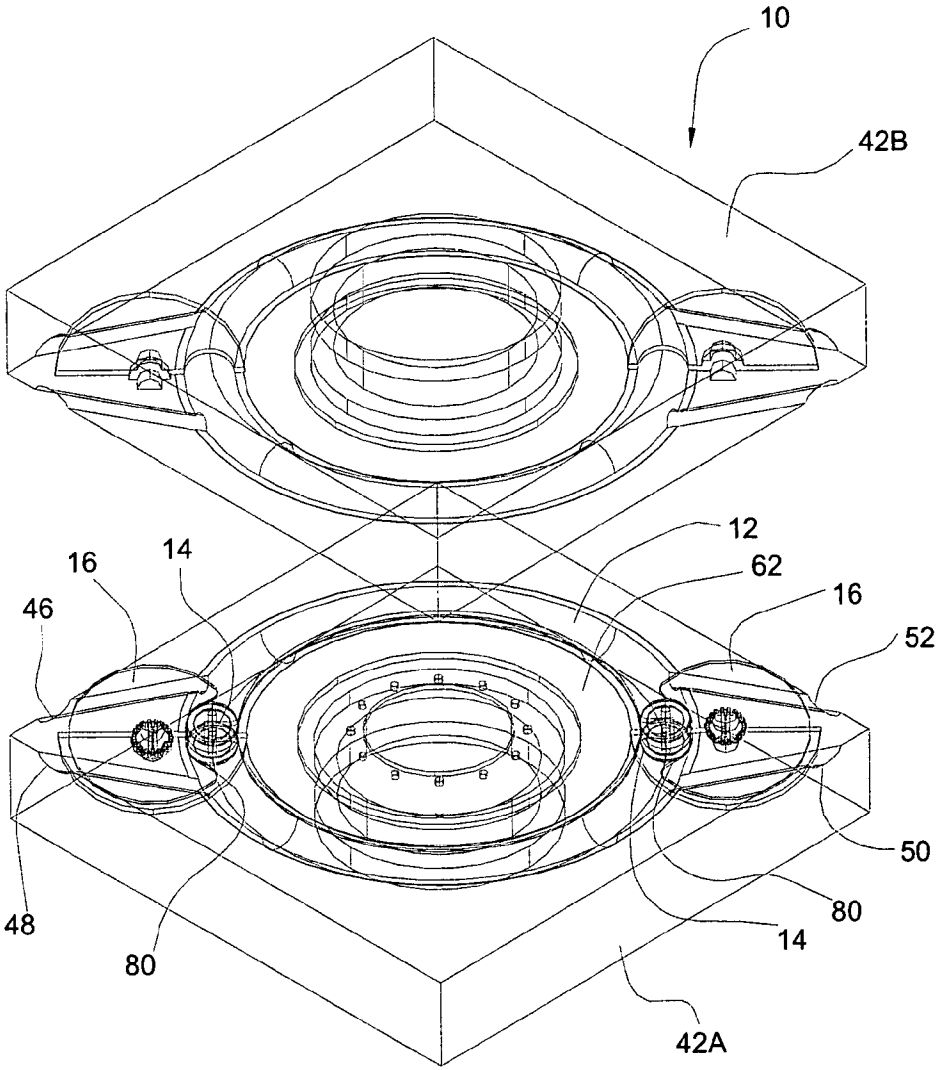
FIG. 7B illustrates an exploded perspective view of the engine in the position shown in FIG. 7A.

An alternate chambering valve 16 is shown in FIG. 15, which illustrates a cylinder valve 71 having a cutout notch 72. Cylinder valve 71 rotates about vertical axis A with cutout notch 72 rotating through piston chamber 12. The rotation of cylinder valve 71 is timed such that cutout notch 72 aligns with piston chamber 12 as piston 14 approaches and passed through cutout notch 72 analogously to piston 14 passing through notch 80 of disc valve 16 shown in FIG. 7A and FIG. 7B. Chambering valve cavity 54, 56 would be in the same relative location as shown in FIG. 7A and FIG. 7B, as well as the other relevant FIGs., but instead of being a disc-shape would be a cylinder shape to accommodate cylinder valve 71. With other alternate chambering valves 16, such as a ball valve or a reed valve, chambering valve cavity 54, 56 would be structured to accommodate such alternate shape embodiments.

FIGS. 5 and 6 illustrate preferred embodiments of the structure and structural relationship among pistons 14, connecting disc 62 and crankshaft 60, with FIG. 5 illustrating a solid design incorporating a solid disk or plate 70 and FIG. 6 illustrating a spoke design. In the spoke design an outer ring 68 extends between spokes, wherein in the solid design, the outer edge and the region proximal to the outer edge acts as the outer ring 68. Pistons 14 are attached at or proximal to the outer circumference of connecting disc 62 or outer ring 68 at predetermined positions. As can be seen in FIG. 3B, outer ring 68 extends into slot 64 and with suitable sealing means (not shown) closes slot 64 in such a manner to allow outer ring 68 to rotate about slot 64 and maintain the general integrity of piston chamber 12. The cooperating structure of slot 64, outer ring 68, and known seals or sealing devices, maintains piston chamber 12 as a generally sealed enclosure. A lubricant such as oil or a slippery material such as Teflon® can be injected or placed between outer ring 68 and slot 64 to reduce friction that may be generated as outer ring 68 rotates. Crankshaft 60 is attached perpendicularly at the axial center of connecting disc 62 or through the axial center of disk 70.

FIGS. 7–10 illustrate the general operation of engine 10 by illustrating the rotation of engine 10 in four different positions. FIGS. 7A and 7B illustrate an arbitrarily chosen initial position with chambering valves 16 open and pistons 14 passing through chambering valves 16. In this position, pistons 14 have just completed exhausting fuel combustion products out through exhaust ducts 48, 52 and are passing through notches 80 in preparation for fuel intake.

Figure 8A:
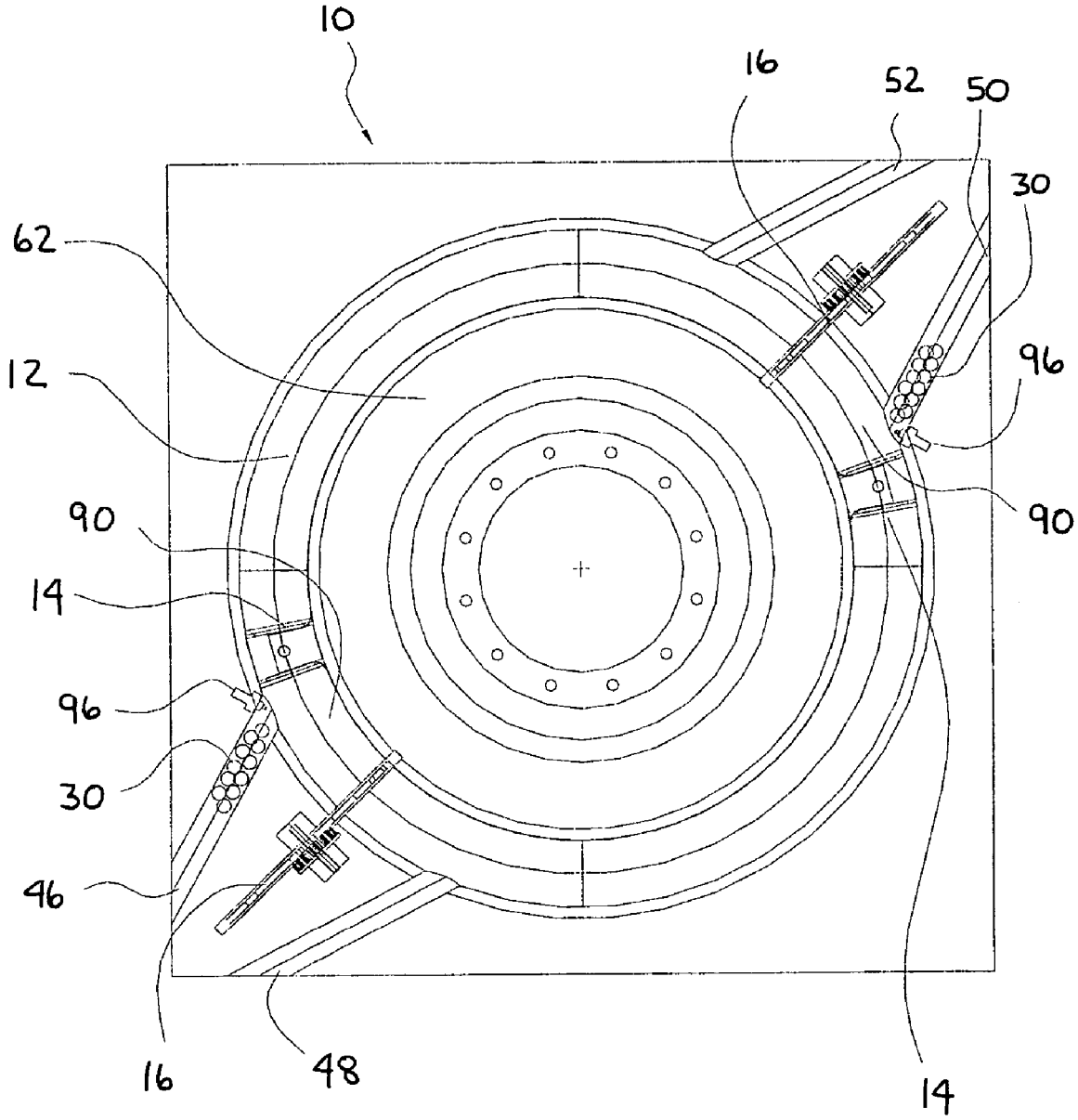
FIG. 8A illustrates a top view of a position approximately 30° from the initial position with the disc valve closing.
Figure 8B:
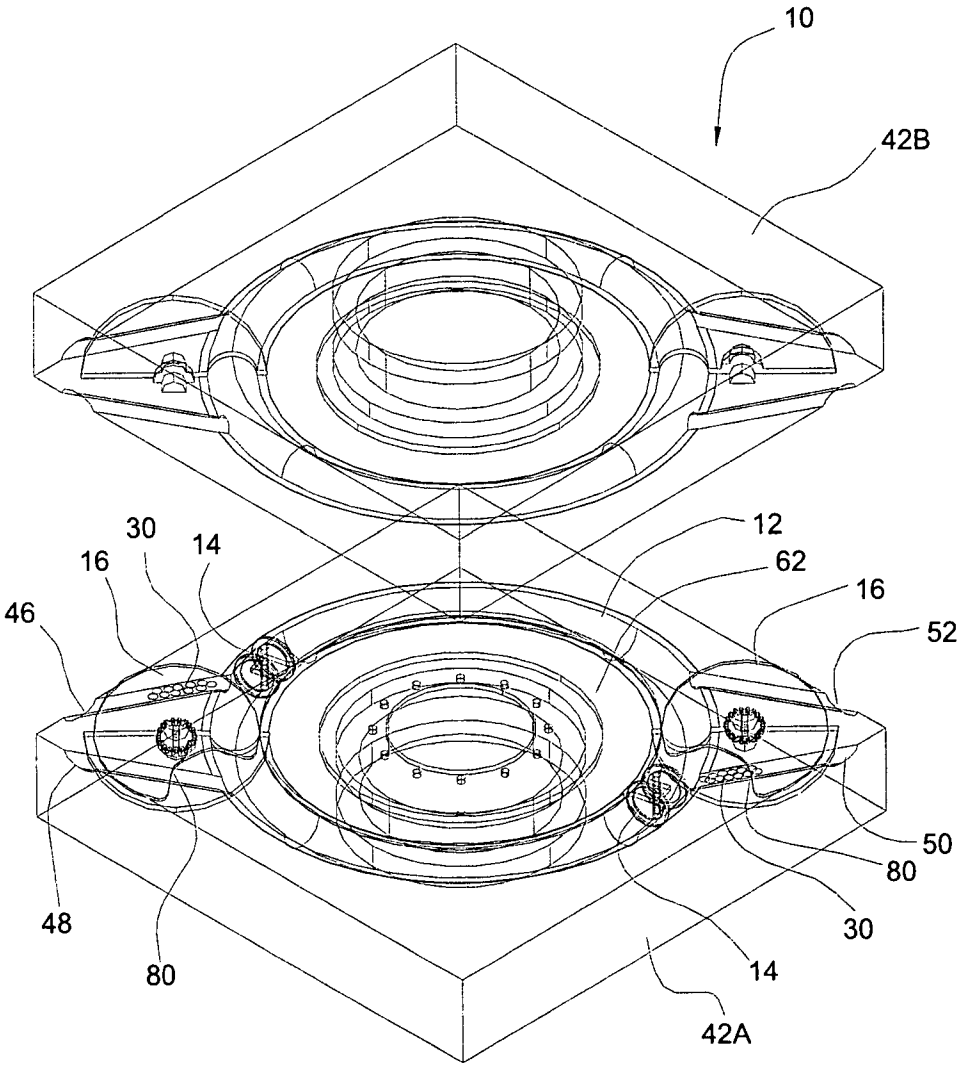
FIG. 8B illustrates an exploded perspective view of the engine in the position shown in FIG. 8A.

FIGS. 8A and 8B illustrate a position approximately 30° from the initial position shown in FIGS. 7A and 7B with chambering valves 16 closing and fuel mixture 30 (small circles) beginning to enter piston chamber 12 between the pistons 14 and the respective chambering valves 16 by way of fuel intake ports 46, 50. The volume of the piston chamber 12 located between the closed chambering valve 16 and the rear side of the piston 14 is the ignition chamber area 90, which incorporates the intake port 46, 50 and the ignition means 96. At the moment (or slightly thereafter) chambering valves 16 rotate to close off piston chamber 12, a spark or other ignition means 96, such as a spark plug, causes fuel mixture 30 to explode (burn) in ignition chamber area 90 causing a rapid expansion of the combustion gases, as in conventional internal combustion engines.

Figure 9A:
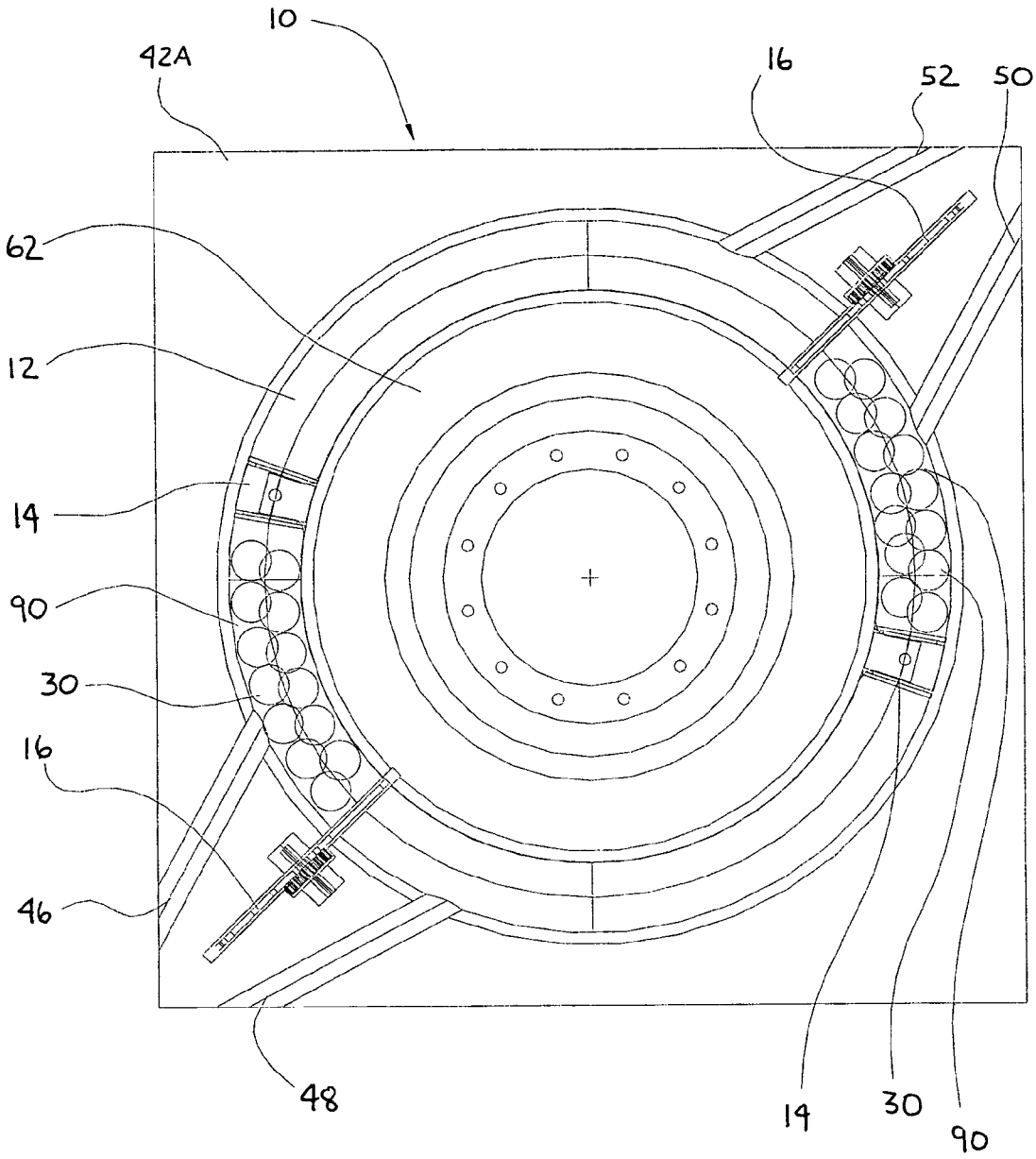
FIG. 9A illustrates a top view of a position approximately 60° from the initial position.
Figure 9B:
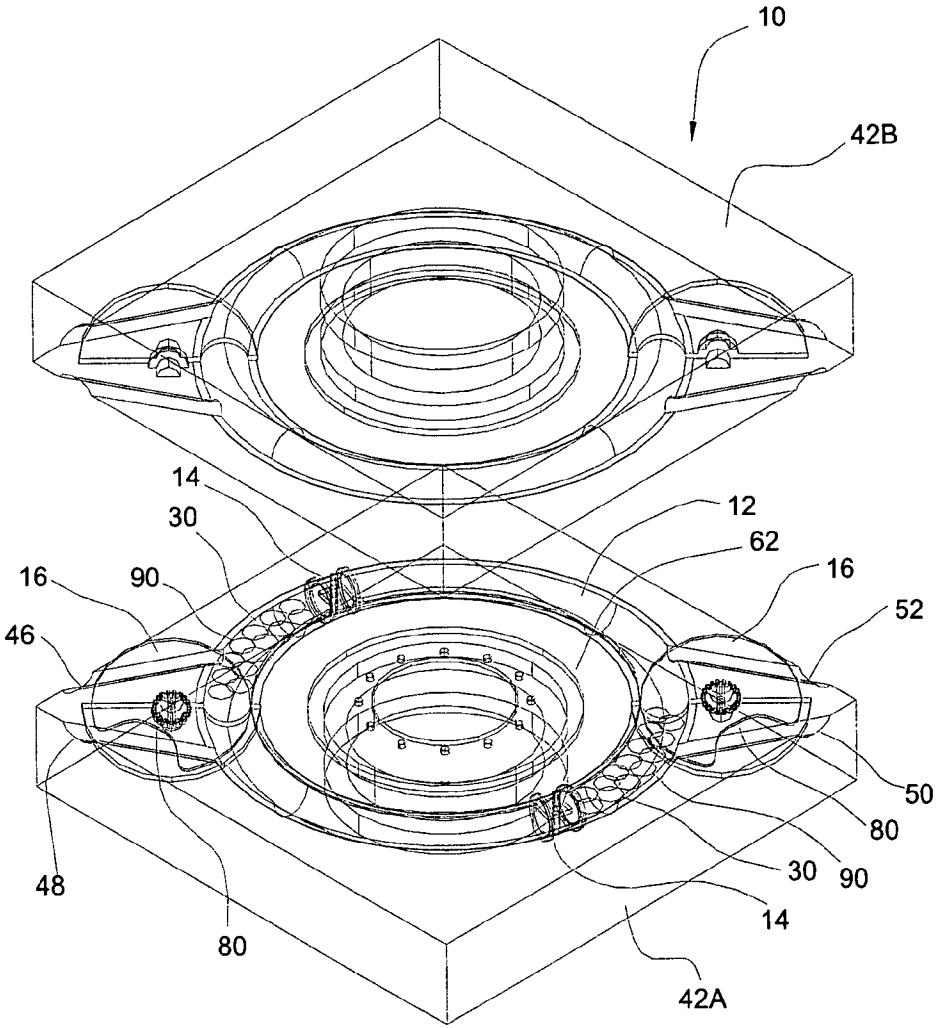
FIG. 9B illustrates an exploded perspective view of the engine in the position shown in FIG. 9A.

FIGS. 9A and 9B illustrate a position approximately 60° from the initial position shown in FIGS. 7A and 7B with fuel mixture 30 ignited and expanding (large circles), imparting power to pistons 14. This forces pistons 14 to continue traveling in the same direction of rotation, which in turn is transmitted via connecting disc 62 to crankshaft 60. Chambering valves 16 still are closing off piston chamber 12 during this step.

Figure 10A:
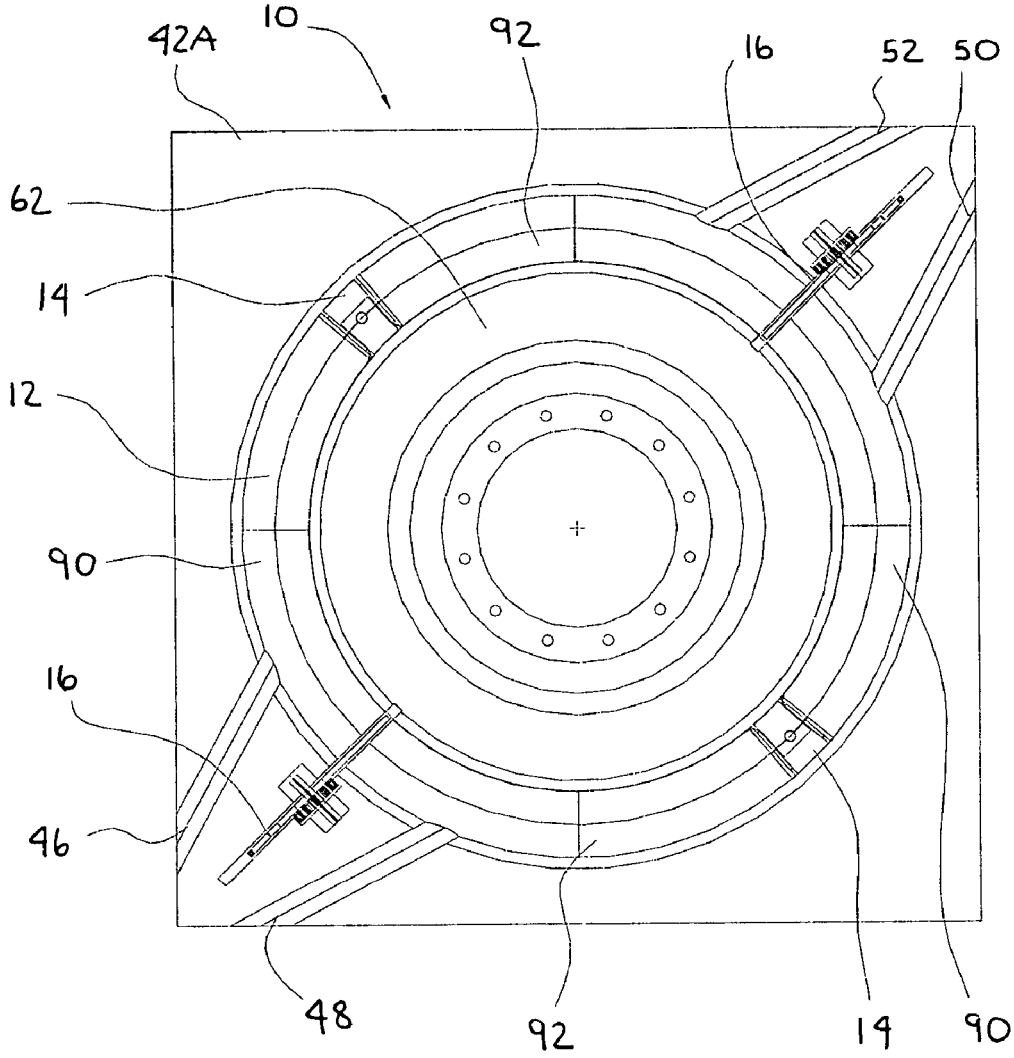
FIG. 10A illustrates a top view of a position approximately 90° from the initial position.
Figure 10B:
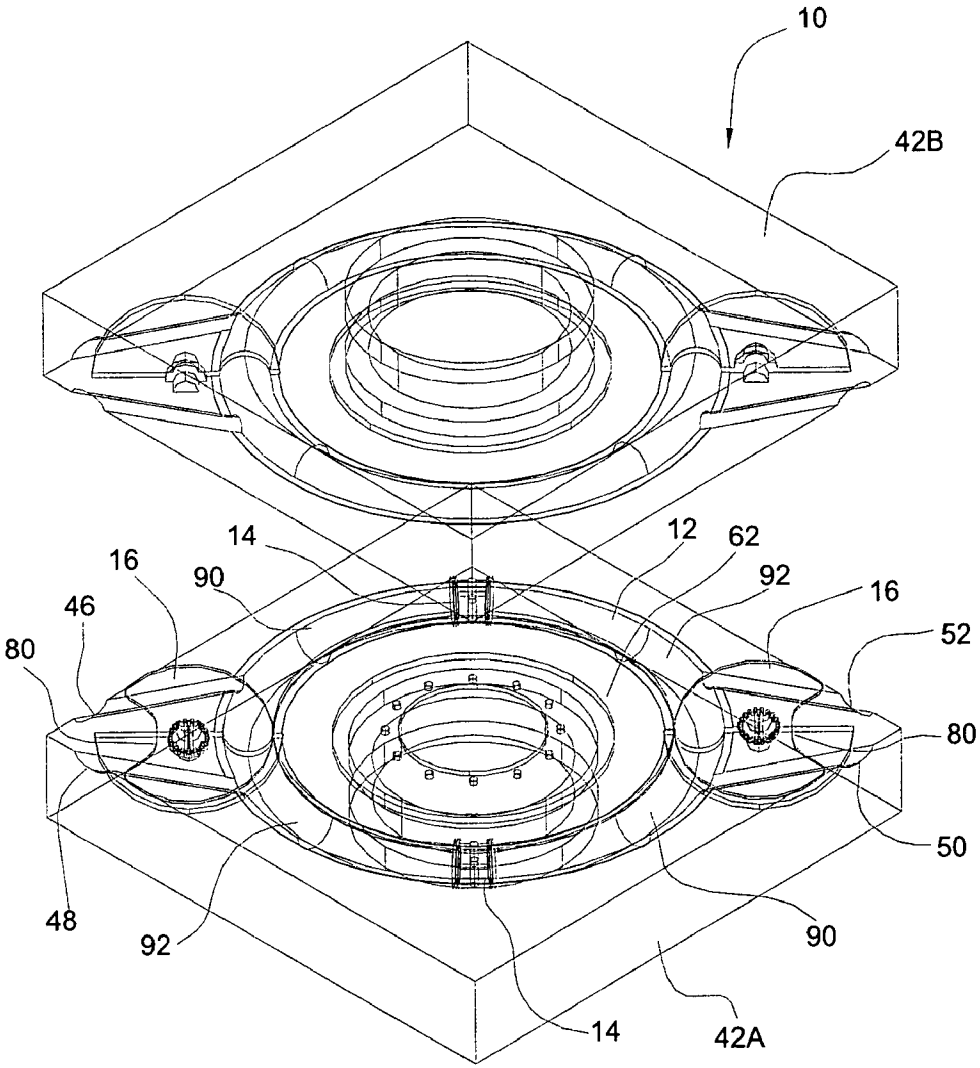
FIG. 10B illustrates an exploded perspective view of the engine in the position shown in FIG. 10A.

FIGS. 10A and 10B illustrate a position approximately 90° from the initial position shown in FIGS. 7A and 7B with pistons 14 continuing their powered travel through piston chamber 12 and forcing exhaust gases from a preceding combustion ahead of them and out of exhaust ports 48, 52. Chambering valves 16 still are closing off piston chamber 12 during this step, forcing exhaust gases from a preceding combustion to exit piston chamber 12 through exhaust ports 48, 52. The volume of the piston chamber 12 located between the closed chambering valve 16 and the front side of the piston 14 is the exhaustion chamber area 92, which incorporates the exhaust port 48, 52. As pistons 14 move closer to chambering valves 16 (that is, each piston 14 is moving closer to the next sequential chambering valve 16), notch 80 rotates into piston chamber 12 allowing pistons 14 to pass through notch 80, returning to the position shown in FIGS. 7A and 7B.

FIG. 11 illustrates an alternative embodiment with multiple chambering valves 16 per piston 14. For example, there can be two chambering valves 16 and two, four, six, eight, or more pistons 14 in multiples of two, with the multiple pistons 14 being separated equidistant around piston chamber 12 so that the power applied to connecting disc 62 is balanced. Likewise, there can be three chambering valves 16 cooperating with three, six, nine, or more pistons 14 in multiples of three. FIG. 12 illustrates an alternative embodiment with multiple pistons 14 per chambering valve 16. In a multiple module configuration, the possibility exists that each module could have one piston 14, and or one chambering valve 16, as long as the remaining modules are staggered to create a balanced force. Depending on size, weight and other factors, a single piston 14, single chambering valve 16 design could be built.

Fuel mixture 30 can be valved or injected into ignition chamber area 90 in any conventional or future developed manner, such as by fuel injection systems timed to coincide with the proper location of pistons 14. Thus, a fuel injection system, or other fuel introduction system or means, can be timed or connected with the rotation of crankshaft 60 and/or chambering valves 16 by known or future developed mechanical, electrical, electronic, or optical means, or the equivalent. Those of ordinary skill in the art can incorporate such means without undue experimentation.

Preferably, the fuel induction system is much like a normal reciprocating engine, with an exception of a valve train. Instead of using conventional tappet or poppet valves, engine 10 of the present invention can use a rotary disc valve, a reed valve, ball valve, or the like. This allows engine 10 to rotate at higher revolutions per minute without having the valves float. Additionally, this adds to the operational smoothness of engine 10.

Exhaust gases emitted from exhaust ports 48, 52 can be directed through an exhaust system (not shown) to the atmosphere or to an exhaust remediation system. Conventional exhaust components such as catalytic converters and mufflers can be incorporated as desired or necessary.

FIG. 13 shows a modular or multi-unit design incorporating four engine units. More specifically, FIG. 13 shows the use of four engines 10 connected serially to a common crankshaft 60 to create a single engine with more power. Because engine block 42 is of a unit design, each engine block 42 can be identical to other engine blocks 42 and can be combined to create a modular or multi-unit design for more power. Various numbers of engine blocks 42 can be connected serially about a common crankshaft 60 and all can be used to power common crankshaft 60. Further, engine block 42 can be made in various sizes for various power needs. Smaller engine blocks 42 can be made for applications such as lawn mowers and larger engine blocks can be made for applications such as automobile engines. Any number of engine units can be connected together to create engines of more or less power.

Engine 10 can be air-cooled, dissipative-cooled, or liquid-cooled. The low stress and smoothness of engine 10 can lead to such benefits and possibilities. Various known and conventional cooling systems (not shown) can be applied to engine 10 by those of ordinary skill in the art without undue experimentation. An exemplary air-cooled system can comprise directional vanes for directing cooling air towards the various components of engine 10. An exemplary dissipative-cooled system can comprise heat sinks or vanes to pull heat from the various components of engine 10. An exemplary liquid-cooled system can comprise liquid circulatory pipes or ducts much like the liquid cooling systems of conventional internal combustion engines. Such cooling methods and systems are known in the art.

The engine design of the present invention has a number of benefits. This engine has increased efficiency over reciprocating engines based on the centrifical momentum generated versus the transfer of kinetic and potential energy in a reciprocating piston. Additionally, with this engine, there is no need to compress the fuel air mixture between the piston head and the cylinder or to create a vacuum for pulling the fuel air mixture into the piston chamber. Further, the force of the piston is always perpendicular to the direction of rotation and consistently is the same distance from the axis of rotation.

This engine has increased horsepower and torque. The torque increase is a result of a longer torque arm. This engine can turn at higher revolutions per minute without detrimental changes of direction of the pistons, and therefore is less self-destructing. There is no reciprocating mass and the valve train is not restricted by the revolutions per minute of the engine. This engine also has a decreased level of complexity when compared to current engines, has fewer moving parts, and easier maintenance. This engine further has less internal friction and, as a result, can utilize needle, roller, or ball bearings rather than plain bearings found in conventional engines.

This engine has a higher power to weight ratio, meaning it can be smaller and have a decreased weight for the amount of power generated. The structure of this engine can be less rigid and use less material. As a result, this engine can be scaled up or down in size for use in a variety of devices, from small-sized gardening equipment such as weed trimmers and lawn mowers, to medium-sized engines such as motorcycle engines and electrical generators, to large-size automotive engines, to even larger-sized locomotive, ship, and power plant engines.

Further, this engine is modular in design in that several engine units can be stacked together to create a multi-unit design, analogous to multi-cylinder conventional engines. This modular design makes it easier to add performance by simply adding additional units, decreases the cost of manufacturing as each unit can be identical, and makes it easier maintain as individual units can be replaced upon malfunction. In other words, combining units can be considered to be combining completely separate engines combined than adding cylinders. Adding cylinders to a standard engine on a shop or consumer level is not possible. Also, if a cylinder goes bad in a standard engine, the entire engine has to be rebuilt. With this engine, an individual can easily add or remove modules. If one module goes bad, one simply can replace or repair only that module.

The above detailed description of the preferred embodiments, examples, and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A method of operating an engine, comprising the steps of:

providing an engine comprising a base member including a toroidal piston chamber; a plurality of pistons disposed for orbital rotation within the piston chamber, each piston having a front side and a rear side; and a plurality of rotatable valves, each valve being configured to alternately close and open at least a portion of the piston chamber;

advancing a first piston along its orbital rotation past a first valve and advancing a second piston along its orbital rotation past a second valve;

closing the first valve behind the first piston to form a first ignition chamber area located within the piston chamber between the first valve and the rear side of the first piston and closing the second valve behind the second piston to form a second ignition chamber area located within the piston chamber between the second valve and the rear side of the second piston and a first exhaust removal chamber area located within the piston chamber between the first valve and the front side of the second piston, the first exhaust chamber area including exhaust gases from a preceding ignition which occurred in the second ignition chamber area;

closing a third valve ahead of the first piston to form a second exhaust removal chamber area located within the piston chamber between the third valve and the front side of the first piston, the second exhaust removal chamber including exhaust gases from a preceding ignition which occurred in the first ignition chamber area;

introducing a first fuel mixture into the first ignition chamber area and a second fuel mixture into the second ignition chamber area;

igniting the first fuel mixture thereby advancing the first piston further along its orbital rotation and simultaneously igniting the second fuel mixture thereby advancing the second piston further along its orbital rotation, wherein the ignition of the first fuel mixture generates exhaust gases between the first piston and the first valve and forcing the exhaust gases in the first exhaust removal chamber out of the piston chamber through a first exhaust duct and wherein the ignition of the second fuel mixture generates exhaust gases between the second piston and the second valve and forcing the exhaust gases in the second exhaust removal chamber out of the piston chamber through a second exhaust duct; and opening the third valve to permit the first piston to advance past the third valve and opening the first valve to permit the second piston to advance past the first valve.

2. The method of claim 1, wherein the third valve is the next valve that the first piston passes subsequent to passing the first valve and wherein the first valve is the next valve that the second piston passes subsequent to passing the second valve.

3. The method of claim 1, wherein the first valve, the second valve and the third valve are closed simultaneously.

4. The method of claim 3, further comprising the step of opening the second valve, wherein the first valve, the second valve and the third valve are opened simultaneously.

5. The method of claim 4, wherein the first piston and the second piston are coupled together by a connecting member which is coupled to an output member.

6. The method of claim 1, wherein the step of opening the first valve includes the steps of:

providing an opening in the first valve; and rotating the first valve so that the opening is in alignment with the piston chamber.

7. An orbital engine comprising:

a) a toroidal piston chamber;

b) at least one piston disposed for orbital rotation within the piston chamber;

c) at least one chambering valve for alternately closing and opening at least a portion of the piston chamber;

d) at least one intake duct for allowing a fuel mixture to enter the piston chamber;

e) at least one ignition means for igniting the fuel mixture resulting in the combustion of the fuel mixture and the creation of combustion gases;

f) at least one exhaust duct for allowing the combustion gases to exit the piston chamber, g) a connecting disc connected at a first location to the piston; and h) a circumferential slot through the piston chamber through which the connecting disc extends;

wherein as the piston passes by the chambering valve, the chambering valve closes the piston chamber, the fuel mixture is introduced to an ignition chamber area within the piston chamber behind the piston and between the piston and the chambering valve, the ignition means ignites the fuel mixture, and the combustion gases impart power to the piston, thus causing the piston to continue the orbital rotation within the piston chamber.

8. The orbital engine as claimed in claim 7, further comprising a crankshaft connected to a second part of the connecting disc.

9. The orbital engine as claimed in claim 8, wherein the circumferential slot is located on an inner circumference of the toroidal piston chamber and the crankshaft is located along the axial centerline of the toroidal piston chamber.

10. The orbital engine as claimed in claim 8, wherein the circumferential slot is located on an outer circumference of the toroidal piston chamber and the crankshaft is a ring like structure located outside the outer circumference of the toroidal piston chamber.

11. An orbital engine comprising:

a) a toroidal piston chamber;

b) at least one piston disposed for orbital rotation within the piston chamber and having a front side and a rear side;

c) at least one chambering valve, with each valve comprising a notch for alternately closing and opening at least a portion of the piston chamber;

d) at least one intake duct for allowing a fuel mixture to enter the piston chamber;

e) at least one ignition means for igniting the fuel mixture resulting in the combustion of the fuel mixture and the creation of combustion gases;

f) at least one exhaust duct for allowing the combustion gases to exit the piston chamber, g) a connecting disc connected at a first part to the piston; and h) a circumferential slot through the piston chamber through which the connecting disc extends;

wherein as the piston passes by the chambering valve, the chambering valve rotates to close the piston chamber so as to create an ignition chamber area within the piston chamber behind the piston and between the closed chambering valve and the rear side of the piston, the fuel mixture is introduced to the ignition chamber area, the ignition means ignites the fuel mixture, and the combustion gases expand within the ignition chamber area and impart power to the piston by contacting the rear side of the piston, thus causing the piston to continue the orbital rotation within the piston chamber.

12. The orbital engine as claimed in claim 11, further comprising a crankshaft connected to a second part of the connecting disc.

13. The orbital engine as claimed in claim 12, wherein the circumferential slot is located on an inner circumference of the toroidal piston chamber and the crankshaft is located along the axial centerline of the toroidal piston chamber.

14. An orbital engine comprising:

a) a toroidal piston chamber;

b) at least one piston disposed for orbital rotation within the piston chamber and having a front side and a rear side;

c) at least one disc valve, with each disc valve comprising a generally flat circular plate having a notch for alternately closing and opening at least a portion of the piston chamber;

d) at least one intake duct for allowing a fuel mixture to enter the piston chamber;

e) at least one ignition means for igniting the fuel mixture resulting in the combustion of the fuel mixture and the creation of combustion gases;

f) at least one exhaust duct for allowing the combustion gases to exit the piston chamber;

g) an ignition chamber area located within the piston chamber between the disc valve and the rear side of the piston and incorporating the intake duct and the ignition means; and h) an exhaust removal chamber area located within the piston chamber between the disc valve and the front side of the piston and incorporating the exhaust duct, i) a connecting disc connected at a first part to the piston; and j) a circumferential slot through the piston chamber through which the connecting disc extends;

wherein as the piston passes by the disc valve, the disc valve rotates to close the piston chamber so as to create the ignition chamber area, the fuel mixture is introduced to the ignition chamber area, the ignition means ignites the fuel mixture, and the combustion gases expand within the ignition chamber area and impart power to the piston by contacting the rear side of the piston, thus causing the piston to continue the orbital rotation within the piston chamber, whereby the piston forces combustion gases from a previous ignition ahead of the piston into the exhaust removal chamber and out through the exhaust duct.

15. The orbital engine as claimed in claim 14, further comprising a crankshaft connected to a second part of the connecting disc.

16. The orbital engine as claimed in claim 15, wherein the circumferential slot is located on an inner circumference of the toroidal piston chamber and the crankshaft is located along the axial centerline of the toroidal piston chamber.

* * * * *